US011047224B2

(12) United States Patent
Ameen et al.

(10) Patent No.: US 11,047,224 B2
(45) Date of Patent: Jun. 29, 2021

(54) AUTOMATIC COMPENSATION FOR SURGE AND SWAB DURING PIPE MOVEMENT IN MANAGED PRESSURE DRILLING OPERATION

(71) Applicant: Weatherford Technology Holdings, LLC, Houston, TX (US)

(72) Inventors: Sayamik N. Ameen, Houston, TX (US); Jose D. Brana, Cypress, TX (US); Thomas H. Koithan, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/554,465

(22) Filed: Aug. 28, 2019

(65) Prior Publication Data

US 2021/0062635 A1 Mar. 4, 2021

(51) Int. Cl.
*E21B 44/04* (2006.01)
*E21B 7/20* (2006.01)
*E21B 21/08* (2006.01)

(52) U.S. Cl.
CPC ..... *E21B 44/04* (2013.01); *E21B 7/208* (2013.01); *E21B 21/08* (2013.01)

(58) Field of Classification Search
CPC ..... E21B 44/04; E21B 7/208; E21B 21/08
See application file for complete search history.

(56) References Cited

U.S. PATENT DOCUMENTS

2004/0154832 A1 8/2004 Koithan
2005/0087367 A1* 4/2005 Hutchinson ..... E21B 44/00 175/45
2005/0161260 A1 7/2005 Koithan et al.
2007/0151763 A1* 7/2007 Reitsma ..... E21B 21/08 175/48
2012/0227961 A1* 9/2012 Sehsah ..... E21B 21/08 166/250.07
2014/0202767 A1 7/2014 Feasey
2015/0034326 A1 2/2015 Hannegan et al.
(Continued)

OTHER PUBLICATIONS

Oseme, U., et al. (2016) Bottom Hole Pressure Management in a Highly Permeable and Narrow Margin MPD Operation, SPE-AFRC-2571990-MS, In Proc. AAPG/SPE Africa Energy and Technology Conference, Nairobi City, Kenya, Dec. 5-7, 2016.
Rostami, S. A., et al. (2015) Dynamic Calibration of the Empirical Pore Pressure Estimation Methods Using MPD Data, OTC-25953-MS, In: Proc. Offshore Technology Conference, May 4-7, Houston, Texas, USA.
(Continued)

*Primary Examiner* — Vincent H Tran
(74) *Attorney, Agent, or Firm* — Blank Rome LLP

(57) ABSTRACT

A system and method are used in drilling a borehole in a formation. A trip to move a drillstring in the borehole is identified, where the trip is expected to produce a piston effect that changes a downhole pressure of the fluid in the borehole. A peak speed to move the drillstring in the borehole is calculated for the trip, and adjustments to a surface backpressure of the drilling system is calculated for the trip at the calculated peak speed to keep the downhole pressure within a tolerance of the formation. The drillstring is moved in the trip according to the calculated peak speed, and the downhole pressure change produced by the piston effect is counteracted by automatically adjusting the surface backpressure according to the calculated adjustments.

22 Claims, 7 Drawing Sheets

(56) References Cited

U.S. PATENT DOCUMENTS

| | | | | |
|---|---|---|---|---|
| 2015/0345239 | A1* | 12/2015 | Samuel | G05B 15/02 700/282 |
| 2016/0102511 | A1 | 4/2016 | Brana et al. | |
| 2016/0108714 | A1* | 4/2016 | Burress | E21B 45/00 175/40 |
| 2016/0245027 | A1 | 8/2016 | Gumus et al. | |
| 2017/0022798 | A1* | 1/2017 | Samuel | E21B 47/00 |
| 2017/0226813 | A1* | 8/2017 | Northam | E21B 47/06 |
| 2017/0300845 | A1* | 10/2017 | Mandava | G06Q 10/06393 |
| 2017/0314368 | A1* | 11/2017 | Wise | E21B 21/08 |
| 2018/0016858 | A1* | 1/2018 | Aamo | E21B 21/08 |
| 2018/0058187 | A1* | 3/2018 | Magnuson | E21B 44/02 |
| 2018/0266233 | A1* | 9/2018 | Ahmed | E21B 44/00 |
| 2019/0100988 | A1* | 4/2019 | Ellis | E21B 19/00 |

OTHER PUBLICATIONS

Rostami, S. A., et al. (2016) New Generation of MPD Drilling Software—From Quantifying to Control, SPE-181694-MS, In: Proc. SPE Annual Technical Conference and Exhibition, Sep. 26-28, Dubai, UAE.

Salas-Bringas, C., et al. (2006) A calibration method for a new type of rheometer, Annual Transactions of the Nordic Rheology Society, 14.

Olve Sunde Rasmussen, et al. (2007) Evaluation of MPD methods for compensation of surge and swab pressures in floating drilling operations, IADC/SPE 108346, Managed Pressure Drilling & Underbalanced Operations,Mar. 28, Galveston, Texas, pp. 1-11.

International Search Report issued in co-pending PCT Application No. PCT/US2020/044427, dated Oct. 20, 2020, 5 pages.

* cited by examiner

AUTOMATIC COMPENSATION FOR SURGE AND SWAB DURING PIPE MOVEMENT IN MANAGED PRESSURE DRILLING OPERATION

BACKGROUND OF THE DISCLOSURE

Surge and swab effects occur during pipe movements when performing managed pressure drilling (MPD) and other operations. During various points of a drilling operation, tripping of the drillstring may be performed where the drillstring is pulled out of hole (POOH) or run in hole (RIH). For example, a tripping operation may pull the drillstring out of hole to replace a downhole component (e.g., a damaged drillpipe, a worn drill bit, a malfunctioning mud motor, etc.) or to add a downhole component so the drillstring can then be run in back in hole to continue drilling. A trip (movement of the drillstring) may also be done for logging, coming off bottom, reaming the borehole between connections, etc.

When pulling the drillstring out of the borehole, the drillstring is lifted at the derrick, and stands (two or more drill pipe joints) are disconnected from the drillstring and stacked in the derrick in consecutive steps. Any replacements or additions to downhole components can be performed, and the drillstring can be run in hole by reconnecting stands to continue with drilling operations.

Pulling the drillstring out of the hole can decrease the bottom hole pressure due to a swabbing effect. For example, the piston effect between the mud and the drillstring being pulled can create changes in pressure in the borehole. The tools (drill bit, stabilizer, drill collar, etc.) on the bottom hole assembly (BHA) of the drillstring are typically full gauge of the borehole. These tools on the BHA being pulled out of hole can also lift mud in the annulus and produce lower pressures in the formation. An influx of formation fluids can also enter the borehole in response to the upward movement of the drillstring.

By contrast, running the drillstring in hole can increase the bottom hole pressure due to a surging effect. Should the run-in speed be too fast, the increasing bottom hole pressure ahead of the BHA may result in mud losses to the formation due to the increasing bottomhole pressure being greater than the fracture pressure, causing damage to the formation.

The subject matter of the present disclosure is directed to overcoming, or at least reducing the effects of, one or more of the problems set forth above.

SUMMARY OF THE DISCLOSURE

According to the present disclosure, a method is directed to drilling a borehole in a formation using a drilling system. The drilling system circulates fluid in a closed loop between a drillstring and the borehole. The method comprises: identifying a trip to move the drillstring in the borehole, the trip expected to produce a piston effect that changes a downhole pressure of the fluid in the borehole; obtaining, in response to the identified trip, a speed of the drillstring in the borehole for the trip; determining an adjustment to a surface backpressure of the drilling system for the trip of the drillstring at the speed to keep the downhole pressure within a tolerance of the formation; and counteracting the downhole pressure change produced by the piston effect by automatically adjusting the surface backpressure according to the determined adjustment.

To identifying the trip, an instance can be identified for pulling the drillstring out of the borehole that produces swabbing as the piston effect decreasing the downhole pressure of the fluid in the borehole. Likewise, an instance can be identified for running the drillstring in the borehole that produces surging as the piston effect increasing the downhole pressure of the fluid in the borehole.

In one arrangement, obtaining the speed of the drillstring in the borehole for the trip can involve receiving positions of a traveling block over time and determining the speed of the drillstring in the borehole from the received block positions. In another arrangement, obtaining the speed of the drillstring in the borehole for the trip can involve receiving a block speed of the traveling block and determining the speed of the drillstring in the borehole from the received block speed.

In yet another arrangement, obtaining the speed of the drillstring in the borehole for the trip can involve calculating the speed to move the drillstring in the borehole for the trip. For this arrangement, the method can further involve moving the drillstring in the trip according to the speed. For example, drawworks can be operated to move a travelling block connected to the drillstring at a rig of the drilling system.

To calculate the speed to move the drillstring, for example, a peak value of the speed can be determined from hydraulic modelling of the drilling system. To calculate the speed to move the drillstring in the borehole, for example, a distance and a time span can be determined for the movement of the drillstring with a traveling block of the drilling system. A first interval of the time span can be determined in which the traveling block is accelerated for a first portion of the distance to keep the speed, and a second interval of the time span can be determined in which the traveling block is decelerated for a second portion of the distance to keep the speed.

According to the method, the adjustment to the surface backpressure can be determined by: determining a first change in the downhole pressure at a defined depth produced by the piston effect from the movement of the drillstring a distance in the borehole over a time span; determining a second change in the surface backpressure to counter the first change in the downhole pressure and keep the downhole pressure within the tolerance of the formation; and dividing the second change in the surface backpressure into discrete increments at intervals of the time span.

The adjustment to the surface backpressure can be determined by determining a target of the downhole pressure at a depth in the borehole within the tolerance of the formation. Here, the target of the downhole pressure can be determined by determining the target downhole pressure as being at least less than one of: (i) a fracture pressure gradient of the formation for the trip of the drillstring into the borehole expected to produce surging as the piston effect, and (ii) a pore pressure gradient of the formation for the trip of the drillstring out of the borehole expected to produce swabbing as the piston effect.

The adjustment to the surface backpressure can be determined by dividing an amount of the adjustment, to counter the downhole pressure produced by the piston effect, into a plurality of discrete increments. In this way, automatically adjusting the surface backpressure according to the determined adjustment during the trip of the drillstring in the borehole according the speed can involve automatically adjusting the surface backpressure sequentially with the discrete increments during the trip of the drillstring in the borehole according the speed.

Adjusting the surface backpressure to counteract the downhole pressure change in the borehole produced by the piston effect from the movement of the drillstring can include: increasing the surface backpressure a stepped amount at one or more discrete intervals while pulling the drillstring out of the borehole in the trip; or decreasing the surface backpressure the stepped amount at the one or more discrete intervals while running the drillstring in the borehole in the trip.

To adjust the surface backpressure, a position of at least one choke in fluid communication with the fluid flowing out of the borehole in the closed loop can be adjusted.

The method can further comprise monitoring one or more of: a position of at least one choke in fluid communication with the fluid flowing out of the borehole in the closed loop; a measurement of the surface backpressure of the drilling system upstream of the at least one choke; a current depth of the drilling system in the borehole; a current position of a traveling block connected to the drillstring at a rig of the drilling system; and a current end-of-pipe condition on the drilling system in the borehole.

According to the present disclosure, a programmable storage device has program instructions stored thereon for causing a programmable control device to perform a method of drilling a wellbore with drilling fluid using a drilling system according to the methods disclosed herein.

According to the present disclosure, a system is directed for drilling a borehole in a formation. The drilling system circulates fluid in a closed loop between a drillstring and the borehole. The system comprises storage and a programmable control device. The storage stores a hydraulic model of the drilling system drilling the borehole, and the programmable control device is communicatively coupled to the storage.

The programmable control device being configured to: identify a trip to move the drillstring in the borehole expected to produce a piston effect that changes a downhole pressure of the fluid in the borehole; obtain, in response to the identified trip, a speed of the drillstring in the borehole for the trip; determine an adjustment to the surface backpressure for the trip of the drillstring at the determined speed to keep the downhole pressure within a tolerance of the formation; and automatically adjust the surface backpressure according to the determined adjustment during the trip of the drillstring in the borehole according the determined speed to counteract the downhole pressure change produced by the piston effect.

The can further comprise: a drawwork operable to move the drillstring in the borehole; at least one pump disposed at an inlet of the system and operable to pump the drilling fluid into the borehole through the drillstring; at least one choke disposed at an outlet of the system and operable to adjust flow of the drilling fluid from the borehole; and a sensor configured to measure a value of surface backpressure upstream of the at least one choke.

In one arrangement, the programmable control device can be configured to calculate the speed to move the drillstring in the borehole for the trip. In operation then, the programmable control device can be configured to control movement of the drillstring in the trip according to the speed.

The foregoing summary is not intended to summarize each potential embodiment or every aspect of the present disclosure.

DETAILED DESCRIPTION OF THE DISCLOSURE

A system and method automatically compensate for surge and swab effects during pipe movements in a Managed Pressure Drilling (MPD) operation to maintain constant bottom hole pressure (BHP). As noted previously, pulling the drillstring out of the hole in a trip can decrease the bottom hole pressure due to a swabbing effect. For example, the piston effect between the mud and the drillstring being pulled can create changes in pressure in the borehole. The tools (drill bit, stabilizer, drill collar, etc.), which are typically full gauge of the borehole, on the bottom hole assembly (BHA) being pulled out of hole can lift mud in the annulus and produce lower pressures in the formation. An influx of formation fluids can also enter the borehole.

Likewise, running the drillstring in hole in a trip can increase the bottom hole pressure due to a surging effect. Should the run-in speed be too fast, the increasing bottom hole pressure may result in mud losses due to the increasing bottomhole pressure being greater than the fracture pressure of the formation.

Accordingly, the system and method disclosed herein identify an instance when a trip (POOH, RIH) is needed for the drillstring in the borehole. The trip may be needed for any particular reason, such as reaming the borehole between connections, replacing components of the bottom hole assembly, etc. The trip is expected to produce a piston effect (i.e., swabbing effect for POOH, surging effect for RIH) that changes pressure of the fluid in the borehole.

The surface backpressure (SBP) needed to compensate for surge and swab effects depends on a number of factors. The pressures produced by surge and swab effects strongly depend on the rheological properties of the fluid, the dimension of the annulus, the speed of the pipe movement, length of drillstring in the well, the annular clearance between the borehole and the drillstring (BHA), the mud cake in the borehole, cuttings in the borehole, etc. In fact, the values change as drilling continues into an open hole section of a borehole and different depths are reached in the formation.

The disclosed system and method provide more precise estimation of the surface backpressure required and automatically determines changes to be applied to the surface backpressure during trips to avoid influxes from the formation during POOH and to avoid inducing fractures in the formation during RIH, in other hand; to maintain constant bottomhole pressure automatically. The set point for the surface backpressure is calculated using a hydraulics model based on a trip speed of the pipe. As the pipe moves up or down according to the trip speed, the disclosed system and method automatically adjust the surface backpressure to maintain a target bottom hole pressure.

Figure 1:
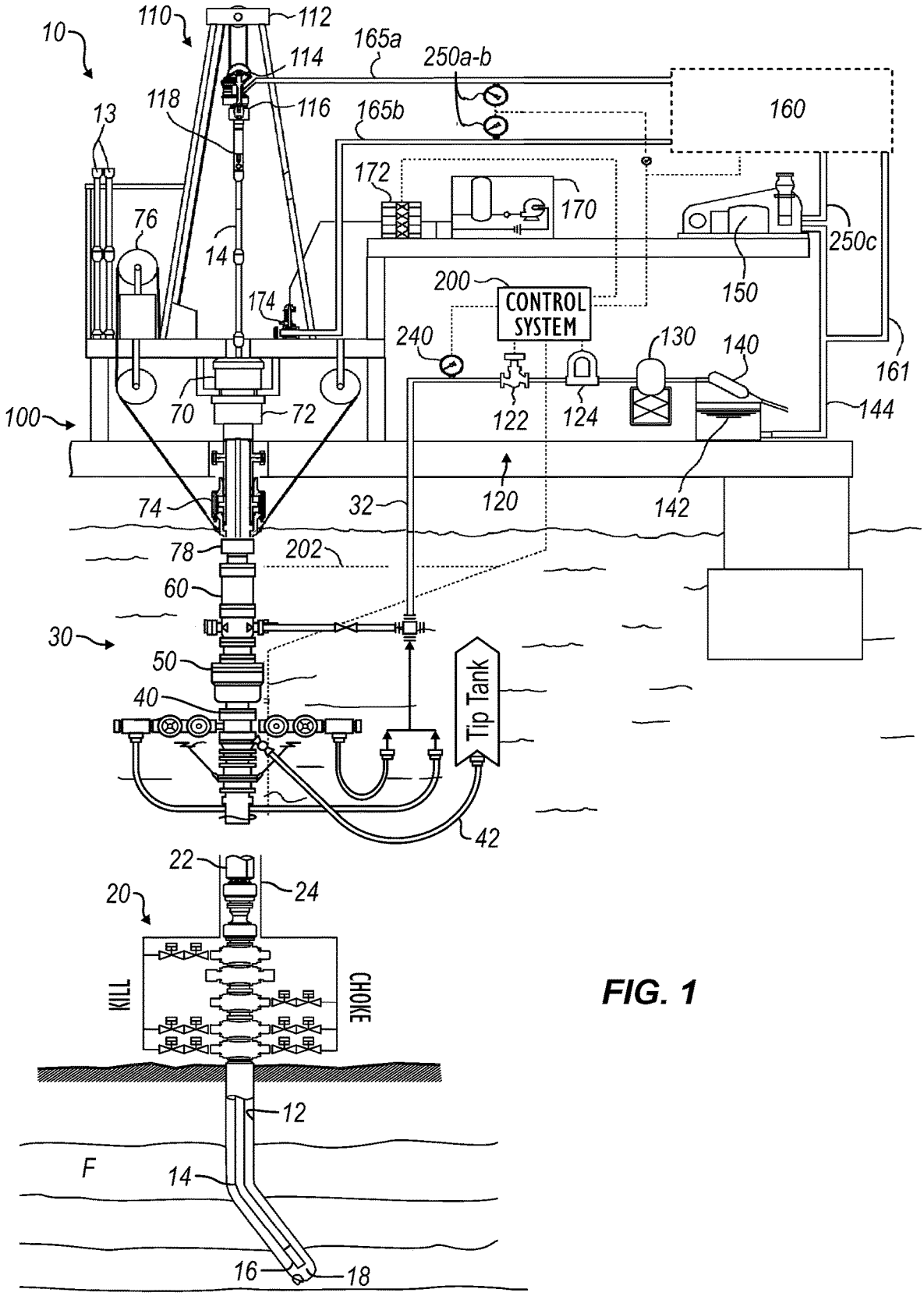
FIG. 1 illustrates a controlled pressure drilling system having a control system according to the present disclosure.

FIG. 1 shows a closed-loop drilling system 10 according to the present disclosure for controlled pressure drilling. As shown and discussed herein, this system 10 can be a managed pressure drilling (MPD) system and, more particularly, a Constant Bottom-hole Pressure (CBHP) form of MPD system. Although discussed in this context, the teachings of the present disclosure can apply equally to other types of controlled pressure drilling systems, such as other MPD systems (Pressurized Mud-Cap Drilling, Returns-Flow-Control Drilling, Dual Gradient Drilling, etc.) as well as to UBD systems, as will be appreciated by one skilled in the art having the benefit of the present disclosure.

The drilling system 10 may be a land-based system or an offshore system. As shown here, the drilling system 10 includes a mobile offshore drilling unit 100, such as a semi-submersible, having a drilling rig 110 and components for fluid handling.

The drilling rig 110 includes a derrick 112 having a traveling block 114 supporting a top drive 116, which couples to a flow sub 118. A top of the drillstring 14 connects to the flow sub 118, such as by a threaded connection, or by a gripper (not shown), such as a torque head or spear. The top drive 116 is operable to rotate the drillstring 14 extending from the derrick 112 and includes an inlet coupled to a Kelly hose to provide fluid communication between the Kelly hose and the flow sub 118 and drillstring 14 extending therefrom.

The drillstring 14 extending from the rig 110 includes a bottom hole assembly (BHA) 16 at the end of the connected joints of drillpipe. The BHA 16 can typically include a drill bit 18, drill collars, stabilizers, a drilling motor (not shown), a measurement while drilling sub, a logging while drilling sub, and the like for drilling a borehole 12.

The drilling system 10 further includes an upper marine riser package (UMRP) 30, a riser 22, auxiliary lines (boost, choke, etc.) 24, and other components. As is customary, the riser 22 extends from the rig 110 to a wellhead 20 located on the sea floor. The riser 22 typically connects to the wellhead 20 with a wellhead adapter, and the wellhead 20 typically has blow-out preventers (BOPS) and connects to the riser lines 24, such as booster line, choke line, kill line, and the like.

The riser package 30 includes a diverter 70, a flex joint 72, a telescopic joint 74, a tensioner 76, a tensioner ring 78, and a rotating control device (RCD) 60. For example, the slip joint 74 includes an outer barrel connected to an upper end of the RCD 60 and includes an inner barrel connected to the flex joint 72. The outer barrel may also be connected to the tensioner 76 by the tensioner ring 78.

The RCD 60 can include any suitable pressure containment device that keeps the wellbore 12 in a closed-loop at all times while the wellbore 12 is being drilled. (As will be appreciated, the wellbore 12 includes the borehole in the formation F and includes the riser 22 which constitutes an extension of the borehole). In this way, the RCD 60 can contain and divert annular drilling returns via a flow line 62 to complete the circulating system to create the closed-loop of incompressible drilling fluid.

The RCD 60 can include any typical construction. For example, the RCD 60 may include a housing, a piston, a latch, and a rider. The housing may be tubular and have one or more sections connected together, such as by flanged connections. The rider may include a bearing assembly, a housing seal assembly, one or more strippers, and a catch sleeve. The rider may be selectively longitudinally and torsionally connected to the housing by engagement of the latch with the catch sleeve. The housing may have hydraulic ports in fluid communication with the piston and an interface of the RCD 60. The bearing assembly may support the strippers from the sleeve such that the strippers may rotate relative to the housing (and the sleeve). The bearing assembly may include one or more radial bearings, one or more thrust bearings, and a self-contained lubricant system. The bearing assembly may be disposed between the strippers and be housed in and connected to the catch sleeve, such as by a threaded connection and/or fasteners.

Each stripper in the RCD 60 may include a gland or retainer and a seal. Each stripper seal may be directional and oriented to seal against the drillstring 14 in response to higher pressure in the riser 22 than the UMRP 30. Each stripper seal may have a conical shape for fluid pressure to act against a respective tapered surface thereof, thereby generating sealing pressure against the drillstring 14. Each stripper seal may have an inner diameter slightly less than a pipe diameter of the drillstring 14 to form an interference fit therebetween. Each stripper seal may be flexible enough to accommodate and seal against threaded couplings of the drillstring 14 having a larger tool joint diameter. The drillstring 14 may be received through a bore of the rider so that the stripper seals may engage the drillstring 14. The stripper seals may provide a desired barrier in the riser 22 either when the drillstring 14 is stationary or rotating.

The RCD 60 may be submerged adjacent the waterline. The RCD interface may be in fluid communication with an auxiliary hydraulic power unit (HPU) (not shown) of a control system 200 via control lines 202. An active seal can be used for the RCD 60. Alternatively, the RCD 60 may be located above the waterline and/or along the UMRP 30 at any other location besides a lower end thereof. Alternatively, the RCD 60 may be assembled as part of the riser 22 at any location therealong.

The RCD 60 may be connected to other flow control devices, such as an annular seal device 50, a flow spool 40 having controllable valves, and the like, as used in MPD. The annular seal device 50 can be used to sealingly engage (i.e., seal against) the drillstring 14 or to fully close off the riser 22 when the drillstring 14 is removed so fluid flow up through the riser 22 can be prevented. Typically, the annular seal device 50 can use a sealing element that is closed radially inward by hydraulically actuated pistons. The control lines 202 from hydraulic components on the rig 100 can be used to deliver controls to the annular seal device 50.

The flow spool 40 can include a number of controllable valves (not shown) that connect to flow connections 42 to communicate the internal passage of the riser 22 with rig components on the rig 100. Flow lines 32 from the riser package 30 may be used to communicate flow, and the control lines 202 on the riser 22 may also be used to deliver controls to open and close the controllable valves.

In addition to the riser package 30, the drilling system 10 also includes a choke manifold 120, a shaker 140, mud tanks 142, mud pumps 150. In addition to these, the drilling system 10 includes flow equipment 160 to deliver flow to the drillstring 14 through the Kelly hose connected to a supply line 165*a* or through a clamp 174 connected to a bypass line 165*b* and couplable to the flow sub 118. The clamp 174 and flow sub 118 are part of a continuous flow system that allows flow to be maintained while pipe connections are being made.

One or more return lines 32 connects from the riser package 30 to the choke manifold 120. A return pressure sensor 240, return choke 122, and return flow meter 124 communicate with the flow from the return line 32. After the choke manifold 120, the flow eventually communicates with the mud gas separator 130 and the shaker 140.

A transfer line 144 connects an outlet of the mud tanks 142 to the mud pumps 150. A standpipe 152 connects from the mud pumps 150 to the drilling rig 110 to conduct drilling fluid from the mud pumps 150 to the Kelly hose and other flow connections. The standpipe 152 can include a pressure sensor 250*c* near the pumps 150 or elsewhere in the flow after the pumps 150.

Here, the standpipe 152 also includes flow equipment 160 connected between the mud pumps 150 and the rig 110 for directing drilling flow into the drillstring 14 via the Kelly hose or via the clamp 174. The flow equipment 160 includes a supply line 165*a* connected from the mud pumps 150 to the top drive inlet 114. A supply pressure sensor 250*a*, a supply flow meter (not shown), and a supply shutoff valve (not shown) may be assembled as part of the supply line 165*a*.

Additionally, the flow equipment 160 includes a bypass line 165*b* connecting the standpipe 152 from the mud pump 150 to the clamp 174. An HPU 170 connects by hydraulic lines and manifold 172 to the clamp 174 to control its operation. For example, when the top drive 116 runs the drillstring 14 into the wellbore 12, the clamp 174 can engage the flow sub 118, and the pumped flow of the drilling fluid can be bypassed to the bypass line 165*b*. In this way, continuous flow into the drillstring 14 can be maintained while making up new stands 13 of pipe to the drillstring 14. A bypass pressure sensor 250*b*, bypass flowmeter (not shown), and bypass shutoff valve (not shown) can be assembled as part of the bypass line 165*b*.

Finally, the flow equipment 160 can further include a drain line 161 connecting the transfer line 144 to the supply and bypass lines 165*a-b*. Drain prongs of the drain line 161 can have drain valves, pressure chokes (not shown), and the like connected to an outlet of the mud pump 150.

The pressure sensor 240, 250*a-c* can use any suitable sensor for measuring pressure, such as a pressure transducer, a pressure gauge, a diaphragm-based pressure transducer, a strain gauge-based pressure transducer, an analog device, an electronic device, or the like.

Each choke 122 may include a hydraulic or electric actuator operated by the control system 200 via an auxiliary HPU (not shown). The return choke 122 receiving flow returns diverted from riser package 30 is operated by the control system 200 to adjust surface backpressure in the riser 22 and the wellbore 12 for well control.

The control system 200 of the drilling system 10 integrates hardware, software, and applications across the drilling system 10 and is used for monitoring, measuring, and controlling parameters in the drilling system 10. In this contained environment of the closed-loop system 10, for example, minute wellbore influxes or losses are detectable at the surface, and the control system 200 can further analyze pressure and flow data to detect kicks, losses, and other events. In turn, at least some operations of the drilling system 10 can be automatically handled by the control system 200.

To monitor operations, the control system 200 uses data from a number of the sensors and devices in the system 10. In particular, the control system 200 uses the one or more sensors 240 uphole of the choke manifold 120 to measure pressure in the flow returns from the riser 22 and the wellbore 12. As the choke 122 in the manifold 120 is adjusted, the one or more sensors 240 measure the surface backpressure SBP applied to the riser 22 and the wellbore 12.

In addition, the control system 200 can use the one or more sensors 250*a-c* downstream of the mud pumps 150 to measure pressure in the standpipe 152 (i.e., the standpipe pressure SPP). One or more other sensors (i.e., stroke counters) can measure the speed of the mud pumps 150 for deriving the flow rate of drilling fluid into the drillstring 14. In this way, flow into the drillstring 14 may be determined from strokes-per-minute and/or standpipe pressure SPP. Flowmeters (not shown) after the pumps 150 can also be used to measure flow-in to the wellbore 12.

One or more sensors (not shown) can measure the volume of fluid in the mud tanks 142 and can measure the rate of flow into and out of mud tanks 142. In turn, because a change in mud tank level can indicate a change in drilling fluid volume, flow-out of the wellbore 12 may be determined from the volume entering the mud tanks 142.

Rather than relying on conventional pit level measurements, paddle movements, and the like, the system 10 can use mud logging equipment and flowmeters to improve the accuracy of detection. For example, the system 10 preferably uses the flowmeter 124, such as a Coriolis mass flowmeter, on the choke manifold 120 to capture fluid data—including mass and volume flow, mud weight (i.e., density), and temperature—from the returning annular fluids in real-time, at a sample rate of several times per second. Because the Coriolis flowmeter 124 gives a direct mass rate measurement, the flowmeter 124 can measure gas, liquid, or slurry. Other sensors can be used, such as ultrasonic Doppler flowmeters, SONAR flowmeters, magnetic flowmeter, rolling flowmeter, paddle meters, etc.

Each pressure sensor 240, 250*a-c* may be in data communication with the control system 200. The return pressure sensor 240 measures surface backpressure (SBP) exerted by the returns choke 122. The pressure sensor 250*c* and/or the supply pressure sensor 250*a* measures standpipe pressure (SPP) to the Kelly hose, whereas the pressure sensor 250*c* and/or the bypass pressure sensor 250*b* measures the standpipe pressure SPP to the clamp 174 during connection of a stand of pipe.

As noted above, the return flowmeter 124 may be a mass flow meter, such as a Coriolis flowmeter, and is in data communication with the control system 200. The return flowmeter 124 connected in the return line 62 downstream of the returns choke 122 measures a flow rate of the returns. A supply flowmeter (not shown) can measure a flow rate of drilling fluid supplied by the mud pump 150 to the drillstring 14 via the top drive 116. Additional sensors can measure mud gas, flow line temperature, mud density, and other parameters.

With the overview of an example drilling system 10 provided above, discussion turns to operation of the drilling system 10 in drilling a wellbore 12. During drilling operations, the mud pumps 150 pump drilling fluid from the transfer line 144 (or fluid tank connected thereto), through the standpipe 152 and the Kelly hose to the top drive 116. The drilling fluid may include a base liquid, such as oil, water, brine, or a water/oil emulsion. The base oil may be diesel, kerosene, naphtha, mineral oil, or synthetic oil. The drilling fluid may further include solids dissolved or suspended in the base liquid, such as organophilic clay, lignite, and/or asphalt, thereby forming a mud.

The drilling fluid at the inlet flows into the drillstring 14 via the top drive 116 and flow sub 118. The drilling fluid flows down through the drillstring 14 and exits the drill bit 18 of the BHA 16, where the fluid circulates the cuttings away from the bit 18 and returns the cuttings up an annulus formed between the casing or wellbore 12 and the drillstring 14. The returns (drilling fluid plus cuttings) flowing through the annulus to the wellhead 20 then continue into the annulus of the riser 22 up to the RCD 60.

At the RCD 60, the system 10 uses the RCD 60 to keep the well closed to atmospheric conditions. The returns are diverted into the return line 32 and continue through the returns choke 122 and the flowmeter 124. Therefore, fluid leaving the wellbore 12 flows through the automated choke manifold 120, which measures return flow (e.g., flow-out) and density using the flowmeter 124 installed in line with the chokes 122. The returns then flow into the shale shaker 140, which remove the cuttings. As the drilling fluid and returns circulate, the drillstring 14 may be rotated by the top drive 116 and lowered by the traveling block 114, thereby extending the wellbore 12 into the lower formation F.

Throughout the drilling operation, the fluid data and other measurements noted herein are transmitted to the control system 200, which in turn operates drilling functions. In particular, the control system 200 operates the automated choke manifold 120 to manage surface backpressure and flow during drilling. This can be achieved using an automated choke response in the closed and pressurized circulating system 10 made possible by the RCD 60.

To do this, the control system 200 controls the chokes 122 with an automated response by monitoring the flow-in and the flow-out of the well, and software algorithms in the control system 200 seek to maintain a mass flow balance. If a deviation from mass flow balance is identified, the control system 200 initiates an automated choke response that changes the well's annular pressure profile and thereby changes the wellbore's equivalent mud weight. This automated capability of the control system 200 allows the system 200 to perform dynamic well control or CBHP techniques.

Software components of the control system 200 then compare the flow rate in and flow rate out of the wellbore 12, the injection or standpipe pressure SPP (measured by the one or more sensors 250*a-c*), the surface backpressure SBP (measured by the one or more sensors 240 upstream from the drilling chokes 122), the position of the chokes 122, and the mud density, among other possible variables. Comparing these variables, the control system 200 then identifies minute downhole influxes and losses on a real-time basis to manage the annular pressure (AP) during drilling by apply adjustments to the surface backpressure (SBP) with the choke manifold 120.

By identifying the downhole influxes and losses during drilling, for example, the control system 200 monitors circulation to maintain balanced flow for CBHP under operating conditions and to detect kicks and lost circulation events that jeopardize that balance. The drilling fluid is continuously circulated through the system 10, choke manifold 120, and the Coriolis flowmeter 124. As will be appreciated, the flow values may fluctuate during normal operations due to noise, sensor errors, etc. so that the system 200 can be calibrated to accommodate for such fluctuations. In any event, the system 200 measures the flow-in and flow-out of the well and detects variations. In general, if the flow-out is higher than the flow-in, then fluid is being gained in the system 10, indicating a kick. By contrast, if the flow-out is lower than the flow-in, then drilling fluid is being lost to the formation, indicating lost circulation.

To then control pressure, the control system 200 introduces pressure and flow changes to the incompressible circuit of fluid at the surface to change the annular pressure profile in the wellbore 12. In particular, using the choke manifold 120 to apply surface backpressure SBP within the closed loop, the control system 200 can produce a reciprocal change in BHP. In this way, the control system 200 uses real-time flow and pressure data and manipulates the surface backpressure to manage wellbore influxes and losses.

To do this, the control system 200 uses internal algorithms to identify what event is occurring downhole and can react automatically. For example, the control system 200 monitors for any deviations in values during drilling operations, and alerts the operators of any problems that might be caused by a fluid influx into the wellbore 12 from the formation F or a loss of drilling mud into the formation F. In addition, the control system 200 can automatically detect, control, and circulate out such influxes and losses by operating the chokes 122 on the choke manifold 120 and performing other automated operations.

A change between the flow-in and the flow-out can involve various types of differences, relationships, decreases, increases, etc. between the flow-in and the flow-out. For example, flow-out may increase/decrease while flow-in is maintained; flow-in may increase/decrease while flow-out is maintained, or both flow-in and flow-out may increase/decrease.

During drilling operations, the control system 200 operates the return choke 122 so that a target bottom hole pressure (BHP) is maintained in the annulus during the drilling operation. The target BHP may be selected within a drilling window defined as greater than or equal to a minimum threshold pressure, such as pore pressure (PP), of the lower formation F and less than or equal to a maximum threshold pressure, such as fracture pressure (FP), of the lower formation, such as an average of the pore and fracture BHPs. Alternatively, the minimum threshold may be stability pressure and/or the maximum threshold may be leakoff pressure. Alternatively, threshold pressure gradients may be used instead of pressures and the gradients may be at other depths along the lower formation F besides bottom hole, such as the depth of the maximum pore gradient and the depth of the minimum fracture gradient. Alternatively, the control system 200 may be free to vary the BHP within the window during the drilling operation. A static density of the drilling fluid (typically assumed equal to returns; effect of cuttings typically assumed to be negligible) may correspond to a threshold pressure gradient of the lower formation F, such as being greater than or equal to a pore pressure gradient.

During the drilling operation, the control system 200 can execute a real-time simulation of the drilling operation to predict the actual BHP from measured data, such as from the standpipe pressure SPP measured from the sensor 250*a-c*, mud pump flowrate measured from the supply flowmeter 166*a*, wellhead pressure from any of the sensors, and return fluid flowrate measured from the return flowmeter 124. The control system 200 then compares the predicted BHP to the target BHP and adjusts the return choke 122 accordingly.

During the drilling operation, the control system 200 also performs a mass balance to monitor for instability of the lower formation F, such as a kick even or lost circulation event. As the drilling fluid is being pumped into the wellbore 12 by the mud pump 150 and the returns are being received from the return line 32, the control system 200 may compare the mass flow rates (i.e., drilling fluid flow rate minus returns flow rate) using the respective flow meters 124, 166*a*. The control system 200 may use the mass balance to monitor for formation fluid (not shown) entering the annulus and contaminating the returns or returns entering the formation F.

Upon detection of instability (e.g., kick), the control system 200 takes remedial action, such as diverting the flow of returns from an outlet of the return flowmeter 124 to the mud gas separator 130. A gas detector of the separator 130 can use a probe having a membrane for sampling gas from the returns, a gas chromatograph, and a carrier system for delivering the gas sample to the chromatograph. The control system 200 may also adjust the returns choke 122 accordingly, such as closing the choke 122 in response to a kick and opening the choke 122 in response to loss of the returns.

Alternatively, the control system 200 may include other factors in the mass balance, such as displacement of the drillstring and/or cuttings removal. The control system 200 may calculate a rate of penetration (ROP) of the drill bit 18 by being in communication with the drawworks and/or from a pipe tally. A mass flowmeter may be added to the cuttings chute of the shaker 140. and the control system 200 may directly measure the cuttings mass rate.

Figure 2:
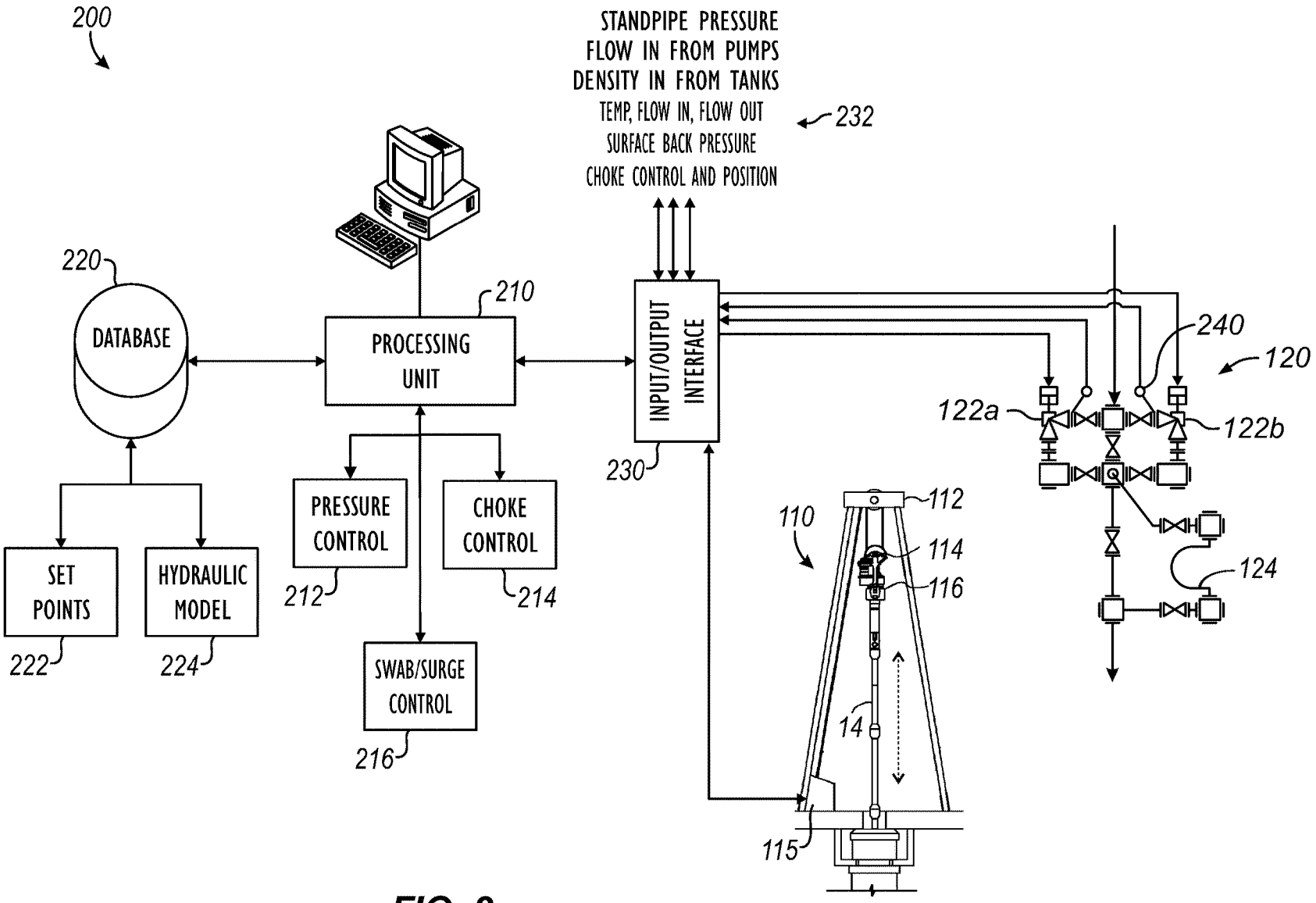
FIG. 2 schematically illustrates the control system of the present disclosure.

Having an understanding of the drilling system 10 and the control system 200, discussion now turns to some additional details of the components of the control system 200. FIG. 2 schematically illustrates some details of the control system 200 of the present disclosure.

The control system 200 includes a processing unit 210, which can be part of a computer system, a server, a programmable control device, a programmable logic controller, etc. Using input/output interfaces 230, the processing unit 210 can communicate with the rig 110, the choke manifold 120, and other system components to obtain and send communication, sensor, actuator, and control signals 232 for the various system components as the case may be. In terms of the current controls discussed, the signals 232 can include, but are not limited to, the choke position signals, block position, drawworks speed, and the like, among other signals, such as pressure signals, flow signals, temperature signals, fluid density signals, etc.

As shown, the choke manifold 120 includes the chokes 122*a-b*, the flowmeter 124, and pressure sensors 240, among other elements, such as a local controller (not shown) to control operation of the manifold 120, and a hydraulic power unit (HPU) and/or electric motor to actuate the chokes 122. The control system 200 is communicatively coupled to the manifold 120 and has a control panel with a user interface and processing capabilities to monitor and control the manifold 120.

The processing unit 210 also communicatively couples to a database or storage 220 having setpoints 222, a hydraulics model 224, and other stored information. The hydraulics model 224 characterizes the well pressure system. This information for the hydraulics model 224 can be stored in any suitable form, such as lookup tables, curves, functions, equations, data sets, etc. Additionally, multiple hydraulics models 224 or the like can be stored and can characterize the system (10) in terms of different system arrangements, different drilling fluids, different operating conditions, and other scenarios.

As will be appreciated, the hydraulics model 224 of the control system 200 can be built based on the various components, elements, and the like in drilling system 10. The hydraulics model 224 can be built with any complexity desired to model the drilling system 10, which as noted above with reference to FIG. 1 can have a great deal of complexity and information associated with it and which can change over time depending on drilling parameters.

The processing unit 210 operates a pressure control 212 according to the present disclosure, which uses the hydraulics model 224. In particular, the processing unit 210 uses the current pressure profile from the pressure control 212 to operate a choke control 214 according to the present disclosure for monitoring and controlling the choke(s) 122*a-b*. For example, the processing unit 210 can transmits signals to one or more of the chokes 122*a-b* of the system 10 using any suitable communication. In general, the signals are indicative of a choke position or position adjustment to be applied to the chokes 122*a-b*. Typically, the chokes 122*a-b* are controlled by hydraulic power so that the signals 232 transmitted by the processing unit 210 may be electronic signals that operate solenoids, valves, or the like of an HPU for operating the chokes 122*a-b*.

As shown here in FIG. 2, two chokes 122*a-b* may be used. The same choke control 214 can apply adjustments to both chokes 122*a-b*, or separate choke controls 214 can be used for each choke 122*a-b*. In fact, the two chokes 122*a-b* may have differences that can be accounted for in the two choke controls 214 used.

As discussed herein, the control system 200 uses the choke control 214 tuned in real-time to manage the surface backpressure, and the control system 200 uses pressure measurements from sensors 240 associated with the choke(s) 122*a-b* to determine the surface backpressure of the system (10).

At times during operation, the drillstring 14 may need to be POOH and then RIH. For example, the drillstring 14 may need to be removed from the borehole (12) stand-by-stand to replace or change components of the BHA (16). The drillstring 14 may then be reinserted stand-by-stand into the borehole 12 to continue drilling into the formation F. Also, when operators make a connection of a new stand at the rig 110 during drilling, the drillstring 14 may be pulled in the borehole 12 by the block 114 and then run in the borehole by the block 114 to ream the previously drilled section of the borehole 12 before continuing with drilling. Once the reaming is done, a new stand can be connected to the drillstring 14 so further drilling of the formation F can be continued.

As discussed herein, the movement of the drillstring 14 in the borehole (12) may produce a piston effect (swabbing/surging) that changes a downhole pressure of the fluid in the borehole (12). To handle swab and surge effects during POOH and RIH respectively, the processing unit 210 uses a swab/surge control 216, which operates in conjunction with the pressure control 212 and the choke control 214 to maintain the bottom hole pressure within tolerances as the processing unit 110 moves the block 114 with the drawworks 115. For surge/swab control during tripping, the controller 200 determines that the drillstring 14 is to be run out of (and/or into) the hole at a given speed and determines the "end of pipe" condition (i.e., open, closed, or auto-fill). In addition, an optimum pipe velocity profile versus depth that maintains the drilling margin is calculated.

For example, the traveling block 114 of the rig 110 may be supported by wire rope connected at its upper end to the crown block 112. The wire rope may be woven through sheaves of the blocks 112, 114 and extend to drawworks 115 for reeling thereof, thereby raising or lowering the traveling block 114 relative to the derrick 110.

To handle swab effects when POOH, the control system 200 can perform automatic adjustments to the choke(s) 122*a-b* in reactive or proactive ways. In a first arrangement to handle swab effects when POOH, the processing unit 210 uses the hydraulics model 224 and determines an optimal speed for moving the drillstring 14. The control system 200 determines choke and SBP setpoints associated with that determined speed and sends commands to the drawworks 115 to move the traveling block 114 and connected drillstring 14 at that determined speed. As the drillstring 14 is moved, the control system 200 then automatically adjusts the choke(s) 122*a-b* to maintain the SBP so the BHP stays within tolerances and can prevent formation fluid from entering the wellbore due to swab effects.

In a second arrangement, the processing unit 210 receives the block position of the traveling block 114 over time and calculates the speed of the pipe movement from the changing block position over time. Here, the traveling block 114 may be separately controlled by other rig systems. Preferably, the traveling block 114 moves the drillstring 14 at a peak optimal speed as disclosed herein, which can be calculated by the control system 200. However, the control system 200 may not directly control the pipe movement.

As the traveling block 114 moves under separate control on the rig 10, the speed of the pipe movement of the drillstring 14 is sent to the hydraulics model 224, and the control system 200 determines the choke and SBP setpoints for the pipe movement at the calculated speed in the hydraulics model 224. From the modelling and as the drillstring 14 is moved, the control system 200 then automatically adjusts the choke(s) 122*a-b* to maintain the SBP so the BHP stays within tolerances and can prevent formation fluid from entering the wellbore 12 due to swab effects.

In a third arrangement to handle swab effects when POOH, the processing unit 210 may receive the speed of the traveling block 114 from some other source on the rig (10). Here, the traveling block 114 may be separately controlled by other rig systems. Preferably, the traveling block 114 moves the drillstring 14 at a peak optimal speed, which can be calculated by the control system 200 as disclosed herein. However, the control system 200 may not directly control the pipe movement.

The speed of the movement of the drillstring 14 is then sent to the hydraulics model 224, and the control system 200 determines the choke and SBP setpoints for the pipe movement at the calculated speed in the hydraulics model 224. From modelling and as the drillstring 14 is moved, the control system 200 then automatically adjusts the choke(s) 122*a-b* to maintain the SBP so the BHP stays within tolerances and can prevent formation fluid from entering the wellbore 12 due to swab effects.

The control system 200 can likewise perform automatic adjustments to the choke(s) 122*a-b* in comparable reactive or proactive ways to handle surge effects when RIH. In a first arrangement to handle swab effects when POOH, the processing unit 210 uses the hydraulics model 224 and determines an optimal speed for moving the drillstring 14. The control system 200 determines choke and SBP setpoints associated with that determined speed and sends commands to the drawworks 115 to move the traveling block 114 and connected drillstring 14 at that determined speed. As the drillstring 14 is moved, the control system 200 then automatically adjusts the choke(s) 122*a-b* to maintain the SBP so the BHP stays within tolerances and can prevent borehole fluid from entering the formation F due to surge effects.

In a second arrangement, the processing unit 210 receives the block position of the traveling block 114 over time and calculates the speed of the pipe movement from the changing block position over time. Here, the traveling block 114 may be separately controlled by other rig systems. Preferably, the traveling block 114 moves the drillstring 14 at a peak optimal speed as disclosed herein, which can be calculated by the control system 200. However, the control system 200 may not directly control the pipe movement.

As the traveling block 114 moves under separate control on the rig 10, the speed of the pipe movement of the drillstring 14 is sent to the hydraulics model 224, and the control system 200 determines the choke and SBP setpoints for the pipe movement at the calculated speed in the hydraulics model 224. From the modelling and as the drillstring 14 is moved, the control system 200 then automatically adjusts the choke(s) 122*a-b* to maintain the SBP so the BHP stays within tolerances and can prevent borehole fluid from entering the formation F due to surge effects.

In a third arrangement to handle swab effects when POOH, the processing unit 210 may receive the speed of the traveling block 114 from some other source on the rig (10). Here, the traveling block 114 may be separately controlled by other rig systems. Preferably, the traveling block 114 moves the drillstring 14 at a peak optimal speed as disclosed herein, which can be calculated by the control system 200. However, the control system 200 may not directly control the pipe movement.

The speed of the movement of the drillstring 14 is then sent to the hydraulics model 224, and the control system 200 determines the choke and SBP setpoints for the pipe movement at the calculated speed in the hydraulics model 224. From modelling and as the drillstring 14 is moved, the control system 200 then automatically adjusts the choke(s) 122*a-b* to maintain the SBP so the BHP stays within tolerances and can prevent borehole fluid from entering the formation F due to surge effects.

The goal of the automatic surge/swab control during tripping is to satisfy downhole criteria, such as keeping the annular pressure greater than the pore pressure (AP>PP), greater than wellbore strengthening pressures (AP>WBS), greater than leak off test pressure (AP>LOT), less than the fracture pressure (AP<FP), and less than formation integrity test pressure (AP<FIT).

Figure 3A:
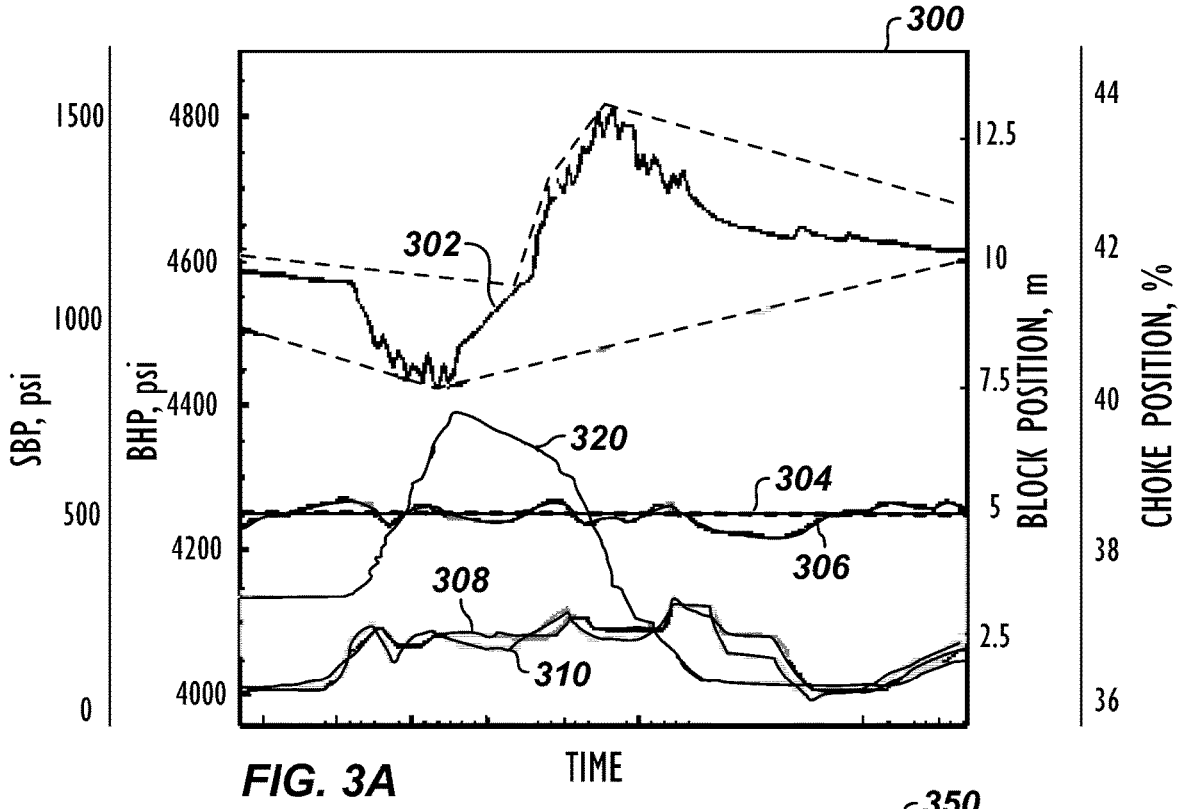
FIG. 3A graphs conventional operation during pipe movement, showing bottom hole pressure, surface backpressure, block position, and choke position over time.

As an example, FIG. 3A shows a graph 300 of a conventional reaming operation performed between drilling connections in which the traveling block (114) pulls the drillstring (14) out of hole and then runs the drillstring (14) into the hole. FIG. 3A graphs traveling block movement 320 as it raises and then lowers the drillstring (14). Upward block movement 320 decreases the bottom hole pressure 302 due to swab effects, whereas downward movement 320 increases the bottom hole pressure 302 due to surge effects. The surface backpressure 306 is kept near a constant setpoint 304 in FIG. 3A by adjustments to the choke setpoint 308 adjusting the choke position 310. Without a determined speed of the block movement 320 and without automatic adjustments to the surface backpressure 306 as taught by the present disclosure, a movement speed of 2 minutes per pipe stand upward by the block movement 320 in this example would result in the bottom hole pressure 302 decreasing by about 156 psi due to the swab effects. As also shown, pipe movement downward with the same speed by the block movement 320 at the speed would increase the bottom hole pressure 302 by about 233 psi due to surge effects. This is a total oscillation of approximately 390-psi in bottomhole pressure.

In contrast to this result in FIG. 3A, the processing unit 210 of FIG. 2 handles swab and surge effects during POOH and RIH using the swab/surge control 216, which operates in conjunction with the pressure control 212 and the choke control 214 to maintain the bottom hole pressure within tolerances by determining a speed for moving the drillstring 14 with the traveling block 114 and automatically adjusting the surface back pressure as the processing unit 210 moves the traveling block 114 with the drawworks 115.

Figure 3B:
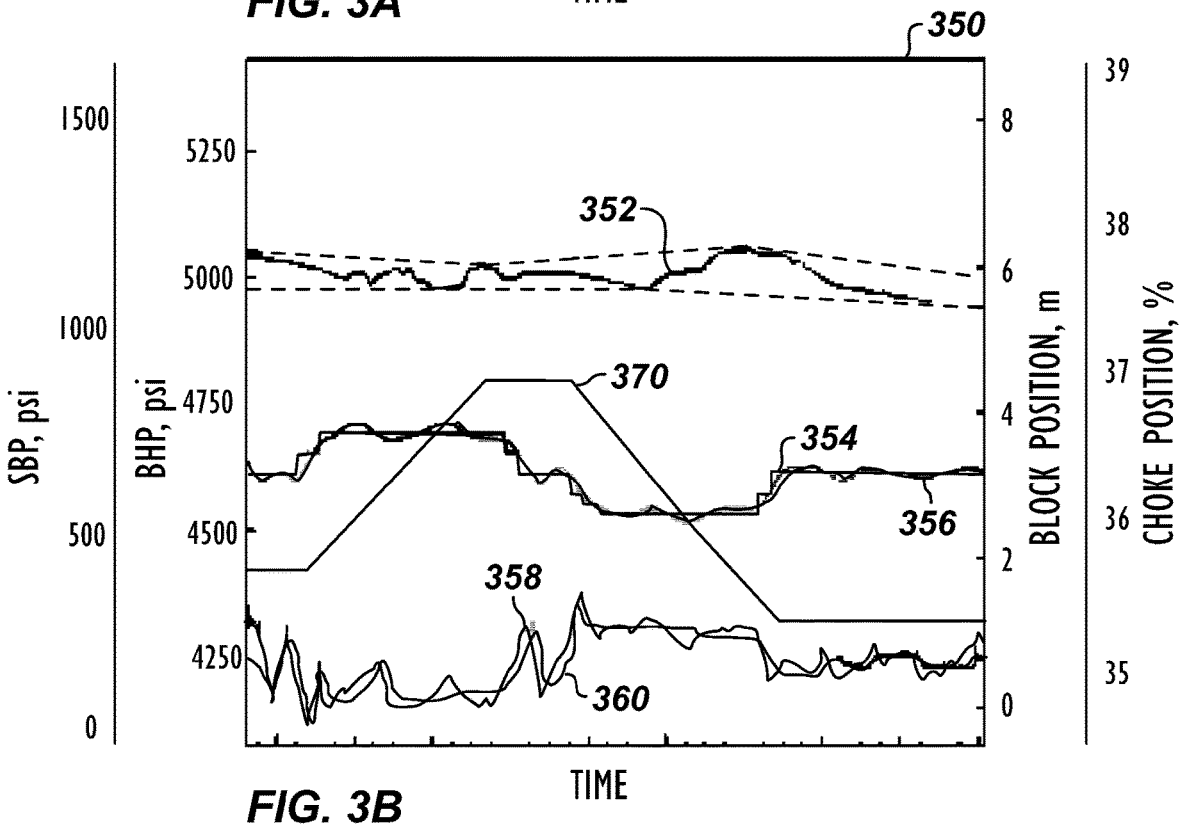
FIG. 3B graphs operation according to the present disclosure during pipe movement, showing bottom hole pressure, surface backpressure, block position, and choke position over time.

As an example, FIG. 3B shows a graph 350 of a modified reaming operation performed between drilling connections in which the traveling block (114) pulls the drillstring (14) out of hole and then runs the drillstring (14) into the hole. Again, FIG. 3B graphs the traveling block movement 370 as it raises and then lowers the drillstring (14). Changes in the choke position 360 (% closed) are graphed as the drill pipe is moved up and down. To counteract the swab effect during upward block movement 370, adjustment to the surface backpressure setpoint 354 and choke setpoint 358 are defined, and the control of the choke position 360 automatically adjusts the surface back pressure 356. To counteract the surge effect during downward block movement 370, adjustment to the surface backpressure setpoint 354 and choke setpoint 358 are defined, and the control of the choke position 360 automatically adjusts the surface backpressure 356. The changes in the choke position 360 respectively increase and decrease the surface backpressure 356 to maintain a more constant bottom hole pressure 352. As can be seen in this example, as the drillstring (14) is moved upward, the surface backpressure 356 is gradually increased from 600-psi to 750-psi to avoid swab. Once the drillstring (14) is moved downward, the surface backpressure 750-psi is reduced to about 550-psi to avoid surge. In the end, the bottom hole pressure 352 remains within a narrower margin of 50-psi.

Figure 4A:
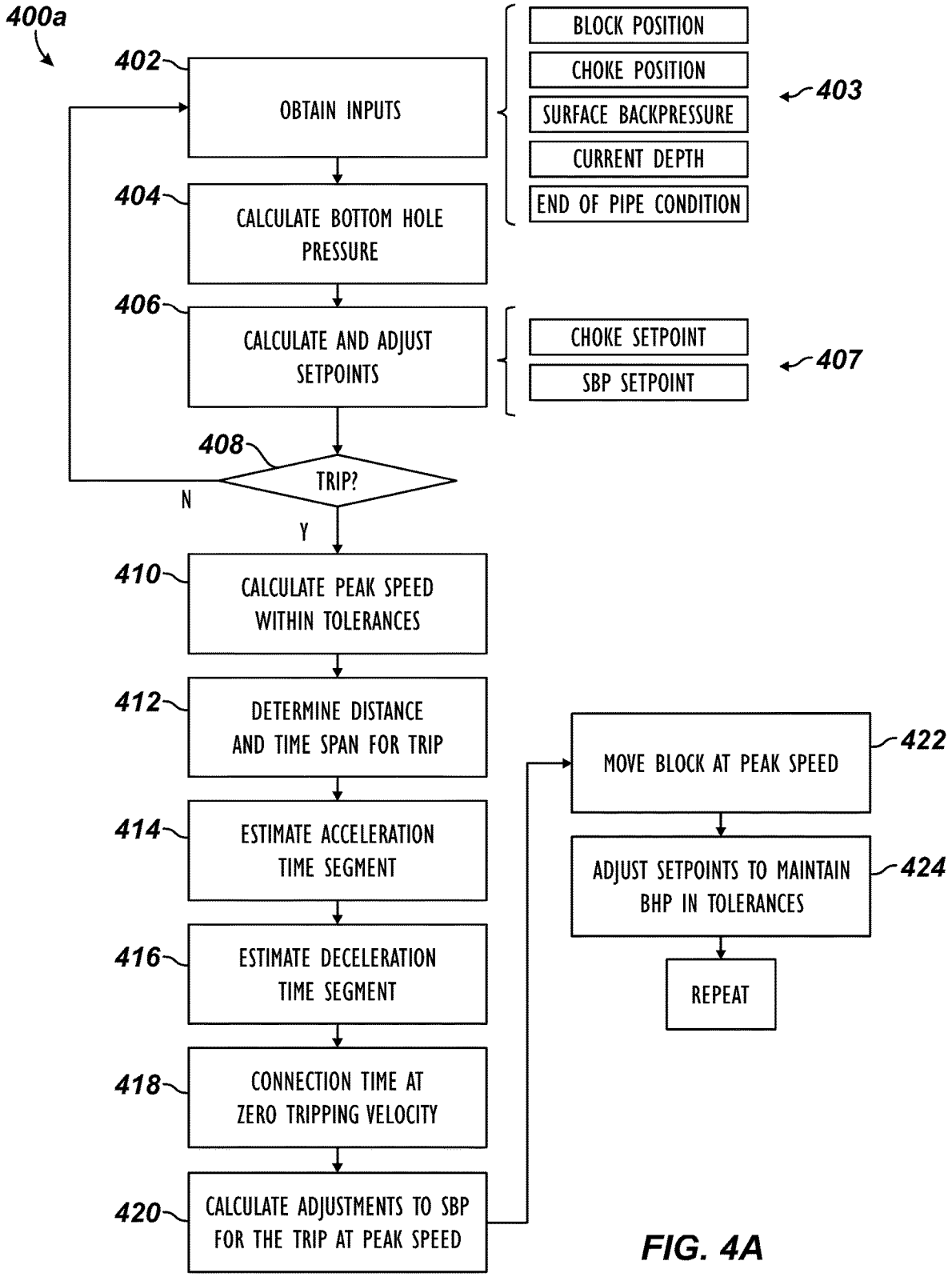
FIGS. 4A-4C illustrate flow charts of processes for drilling a borehole and counteracting swab/surge effects according to the present disclosure when tripping the drillstring.
Figure 4B:
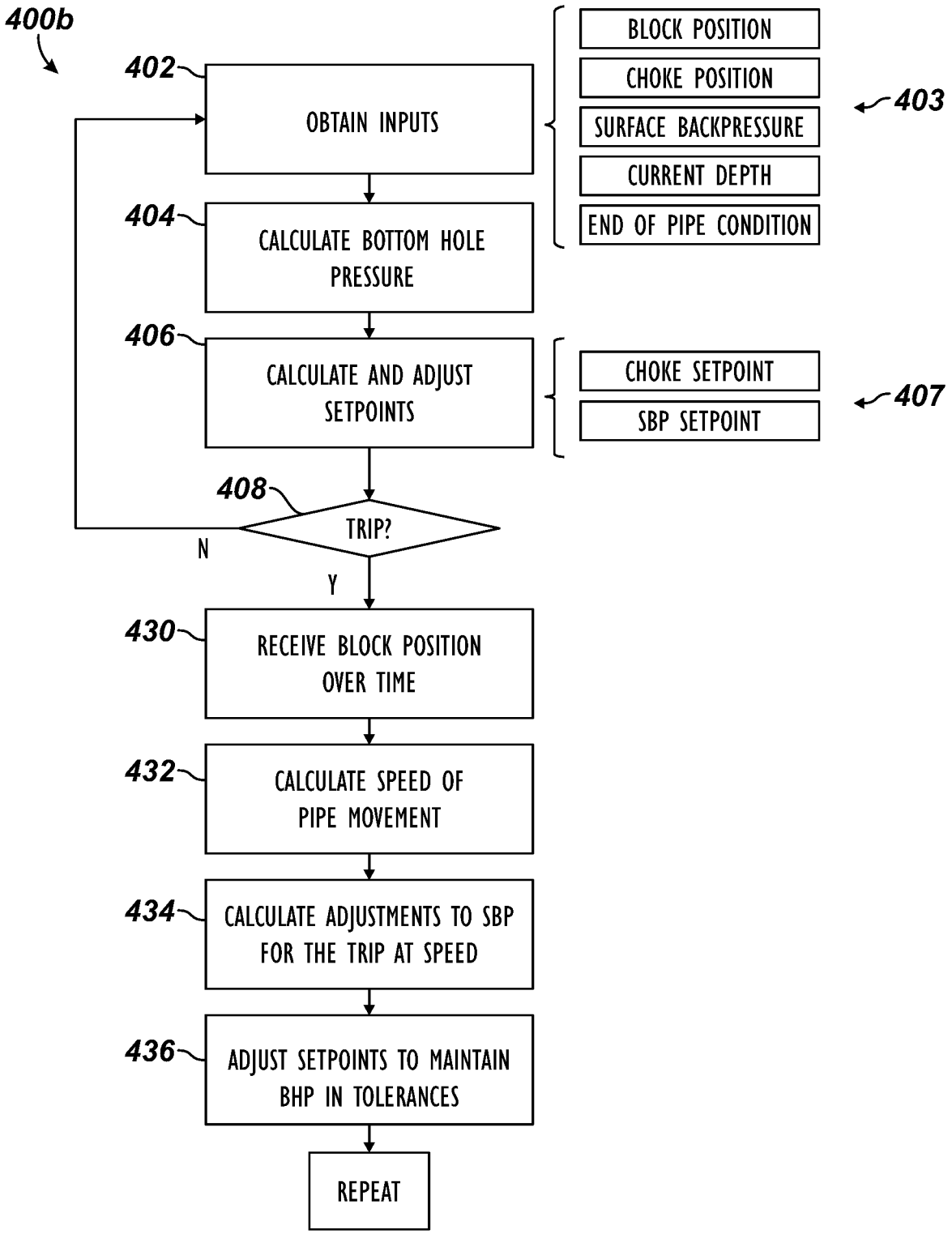
Figure 4C:
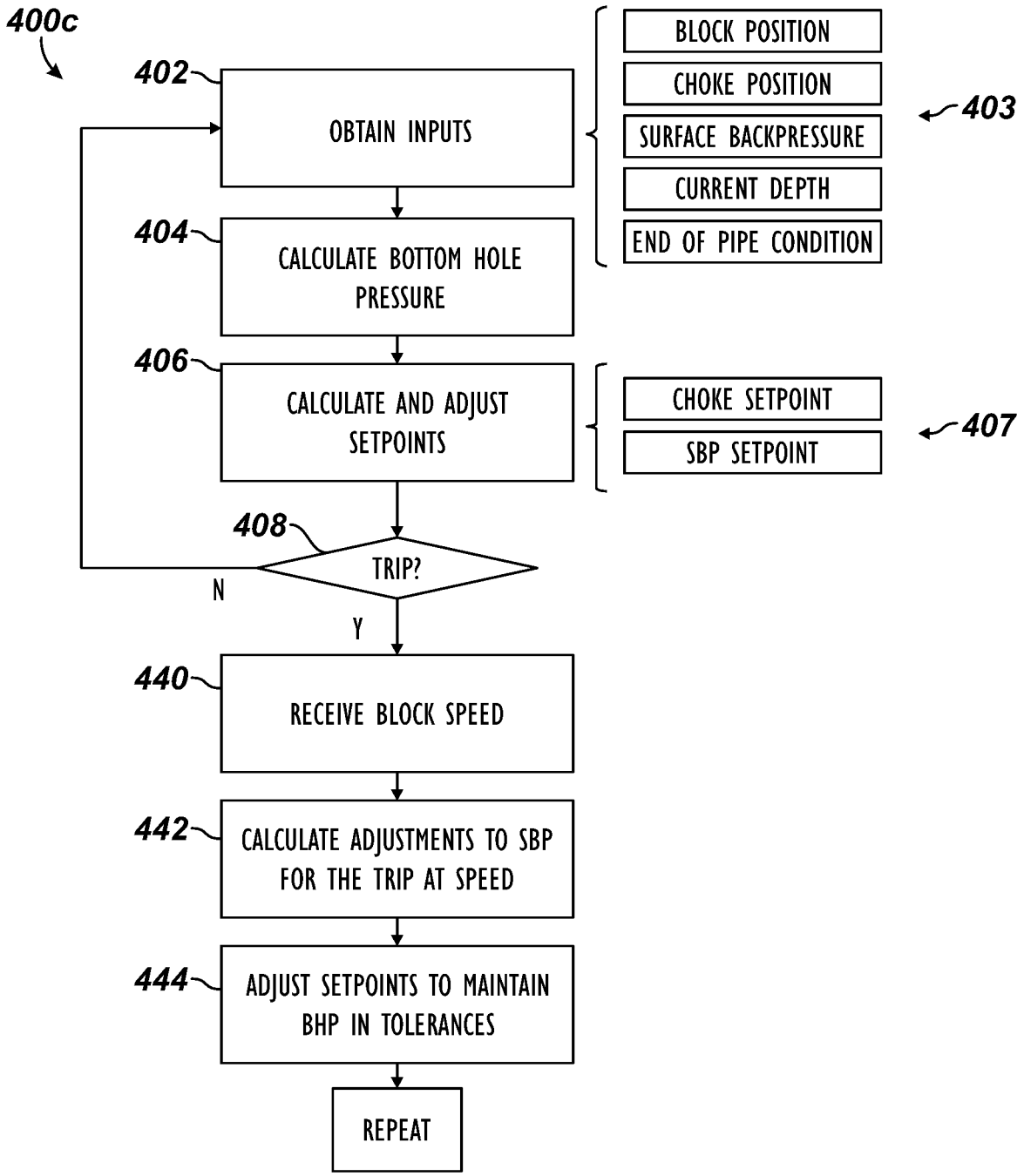

Having an understanding of the drilling system 10 and the control system 200, discussion now turns to processes 400*a-c* in FIG. 4A-4C for drilling a borehole and counteracting swab/surge effects according to the present disclosure when tripping the drillstring. For discussion, reference is made to the drilling system 10 and control system 200 of FIGS. 1-2.

For a first drilling process 400*a* of FIG. 4A, the processing unit 210 obtains drilling inputs by monitoring a number of parameters (Block 402), including the current traveling block position, current choke position, surface backpressure measurement, current drilling depth, and the end of pipe condition (403). As noted, the current choke position can be obtained using sensors on the choke manifold 120, such as position sensors on the chokes 122*a-b*. The current block position can be obtained using WITS data from the rig 10 and may be reported every second. The surface backpressure can be measured using pressure sensors 240 at the choke manifold 120 or elsewhere uphole of the chokes 122*a-b*. The end of pipe condition may be opened, closed, or autofill, depending on the configuration of the BHA 16.

From some of these inputs (403), the current bottom hole pressure is calculated (Block 404), and setpoints for the choke(s) 122*a-b* and the surface backpressure are calculated (Block 406). This is done to maintain the desired bottomhole pressure setpoint while drilling the borehole 12. The calculated choke setpoint equates to a choke position (% closed) intended to produce a calculated SBP setpoint that maintains the bottom hole pressure within the target setpoint of the sections of formation (i.e., pore pressure, fracture pressure, etc.) being drilled. Adjustments are made to the choke(s) 122*a-b* as drilling proceeds to track the changing setpoints to stay within the target setpoint.

Eventually, some form of trip must be made during drilling in which the drillstring 14 is pulled out of hole and then run in hole. The processing unit 210 identifies an instance when a trip for the drillstring 14 in the borehole 12 is needed, planned, initiated, started, or the like (Decision 408). The trip may be expected to produce a piston effect that changes a downhole pressure of the fluid in the borehole 12. For example, an instance can be identified for pulling the drillstring 14 out of the borehole that produces swabbing as the piston effect decreasing the downhole pressure of the fluid in the borehole 12. Likewise, an instance can be identified for running the drillstring 14 in the borehole 12 that produces surging as the piston effect increasing the downhole pressure of the fluid in the borehole 12. In fact, both POOH and RIH may be indicated to ream the borehole 12 before a new connection of a stand to the drillstring 14.

For the identified trip (Block 408), the run time for the trip is divided into discrete segments for the pipe movement by the traveling block 114. When tripping the drillstring 14 out of the hole stand-by-stand, the trip for lifting each stand is divided into discrete segments for the pipe movement by the block 114. When running the drillstring 14 into the hole stand-by-stand, the trip for running each stand is divided into discrete segments for the pipe movement by the block 114. While drilling, the drillstring 14 may also be lifted and lowered between consecutive connection operations to ream the borehole 12. For example, the pipe is POOH by lifting the block to its upper extent, and the pipe is then RIH by lower the block to its lower extent. This can involve moving the block and connected drillstring 90-feet up and then back down. This operation can act to ream the recently drilled open hole section before a new stand is to be connected so drilling ahead can be continued.

In either of these instances of POOH or RIH, movement of the drillstring 14 will be made a distance in a direction in the borehole 12 relative to a current depth, and the movement of that distance in that direction may produce the piston effect changing the bottom hole pressure of the fluid in the borehole 12. In response to the identified trip, the processing unit 210 calculates a trip speed to trip (POOH, RIH) the drillstring 14 in the borehole 12 (Block 410). The determined optimum trip speed is preferably a peak speed (e.g., fastest possible speed, optimal speed, etc.) to move the pipe under current conditions with the required SBP. A speed that is too slow would slow down the drilling operation, resulting in lost time. A speed that it too fast would exacerbate the issues with swab/surge and complicate the ability to counteract them.

To determine the peak speed, the processing unit 210 uses a value for the peak speed calculated from hydraulic modelling of the drilling system 10 in the borehole 12. The hydraulics model 224 of the control system 200 summarizes the borehole 12 by equating depths in the borehole 12 to maintain bottom hole pressure at trip speeds of the drillstring 14 for POOH and RIH by applying adequate SBP. This is typically broken into sections of the depth in the borehole 12. Expected surface backpressure to be applied during the trip can be determined from the hydraulics model 224 to counter the expected change in bottom hole pressure during the trip. This modeling is typically verified by fingerprinting the borehole 12 while in-casing operations.

In particular, the peak speeds for RIH and POOH can initially be determined form modelling with the hydraulics model 224 of the well. These speed estimates are linked to expected changes in the bottom hole pressure at different depths in the borehole 12. A level of surface backpressure while tripping would then be indicated based on the expected change in the bottom hole pressure.

Fingerprinting of the well can then be done during operations to verify and refine these estimates so that operators will have verified information about the peak trip speeds at different depths, the expected change in the bottom hole pressure accompanying those trip speeds, and the correlated surface backpressure needed to counteract the BHP change so that the bottom hole pressure remains within the accepted margin between the pore pressure gradient and fractur pressure gradient.

An example table of a well fingerprinted for POOH may be as follows:

| POOH Schedule<br>Total Trip Time = 40 hrs. | | | | |
|---|---|---|---|---|
| From, m | To, m | Trip Speed, min/std | SBP while trip, psi | Total trip time, min |
| 6523 | 6000 | 7 | 130 | 122.0 |
| 6000 | 5000 | 5 | 120 | 166.7 |
| 5000 | 4000 | 4 | 120 | 133.3 |
| 4000 | 3000 | 3 | 100 | 100.0 |
| 3000 | 1702 | 3 | 80 | 129.8 |
| 1702 | 0 | 3 | 50 | 170.2 |

During POOH in this example, the determined surface backpressure according to the above table would need to be applied to avoid swabbing. While the drillstring 14 is static and not moved, then the surface backpressure would be released or move back to static SBP value. A similar schedule for RIH can be derived from the hydraulics model 224 and verified through fingerprinting of the well.

The different speeds of pipe movement and what pressure change they produce in the bottom hole pressure are input into the swab/surge control 216 and used for a relationship between trip speed versus BHP change when performing further analysis.

Figure 5A:
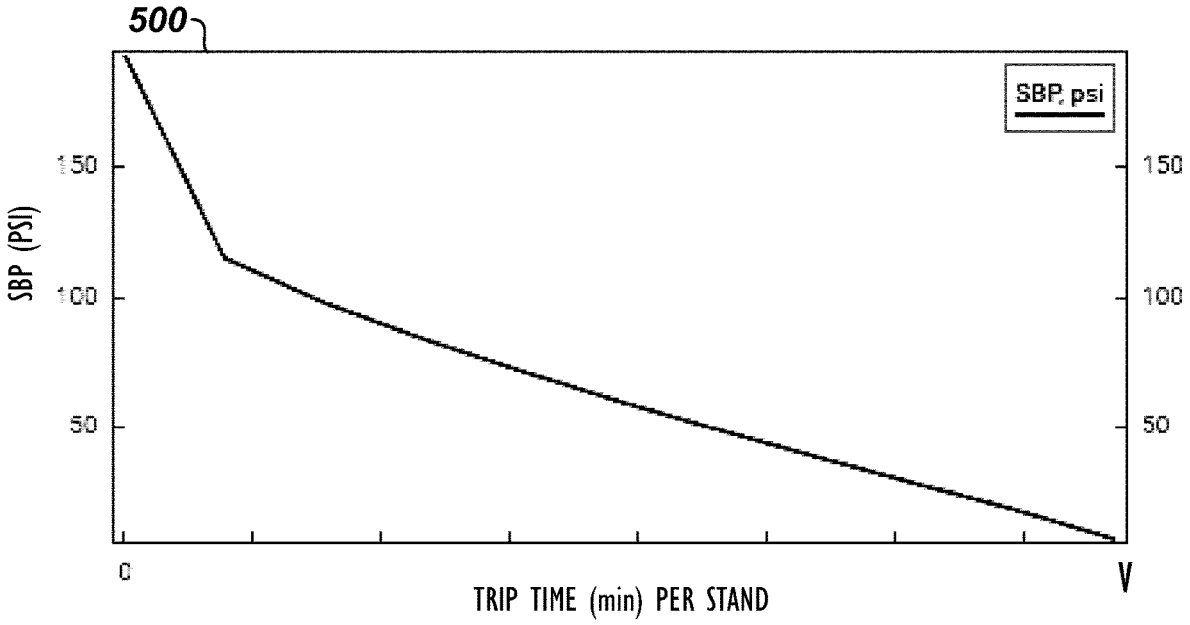
FIG. 5A graphs an example of peak trip speed relative to surface backpressure for the present disclosure.

For reference, FIG. 5A graphs a modelled trip speed as block speed versus surface backpressure. The trip speed is graphed as time (minutes) per stand, being faster when less time is given to move the drillstring 14 per stand. Greater trip speeds correlate to greater surface backpressure adjustments.

To calculate the peak speed based on the modeling and fingerprinting to determine the correlated surface backpressure adjustment, the calculated equivalent circulating density (ECD) is given as a function of a Peak Speed $V_{peak}$ of the pipe movement. When the Peak Speed $V_{peak}$ is 0 (amounting to no pipe movement), then $ECD(V_{peak}=0)$ equals the mud weight (MW). The function is increasing for surge (RIH) and decreasing for swab (POOH).

Based on a current depth, an optimal peak speed $V_{peak}$ is calculated for the pipe movement to control surge and swab effects. (The peak speed $V_{peak}$ may have a maximum value with an accuracy about 0.01 ft/s in some implementations.) The peak speed $V_{peak}$ is calculated iteratively using a bisection method, such that the corresponding ECD satisfies tolerance requirements with respect to total vertical depth (TVD), pore pressure gradient (PPG), fracture pressure gradient (FPG).

Two forms of tolerance can be used—one based on a reference ECD tolerance and another based on pressure gradient tolerance. For calculating the peak speed in surge compensation based on a reference ECD, the ECD at a reference depth is kept below the reference ECD, as given by $ECD(D_{ref})<ECD_{ref}$. For calculating the peak speed in swab compensation based on a reference ECD, the ECD at a bottom hole depth is kept below the fracture pressure gradient FPG, as given by $ECD(D_{BH})<FPG(D_{BH})$.

For calculating the peak speed in swab compensation based on a reference ECD, the ECD at a reference depth is kept above the reference ECD, as given by $ECD(D_{ref})>ECD_{ref}$. Finally, for calculating the peak speed in swab compensation based on a reference ECD, the ECD at a bottom hole depth is kept above the pore pressure gradient PPG, as given by $ECD(D_{BH})>PPG(D_{BH})$.

Continuing with the process 400 of FIG. 4, the processing unit 210 determines an amount of change in the downhole pressure produced by the piston effect from the movement of the drillstring the distance in the direction in the borehole relative to the current depth. For each stand in the trip, the processing unit 210 determines the tripping distance and a time span involved in the movement of the drillstring 14 with the traveling block 114 (Block 412). In this way, the tripping speed is optimized.

During the pipe movement, the pipe is accelerated, and the tripping acceleration/deceleration can be further optimized according to the teachings of the present disclosure to control the pipe movement. For example, the processing unit 210 can calculate the acceleration and deceleration of the traveling block 114 in which to move the block 114 at the peak speed. For instance, an acceleration segment in which the drillstring 14 must be accelerated for POOH and RIH can be calculated for the pipe movement by the traveling block 114 (Block 414), and a declaration segment in which the drillstring 14 must be decelerated for POOH and RIH can be calculated for the pipe movement by the traveling block 114 (Block 416). A connection time can be estimated between the POOH and RIH.

To trip the drillstring 14 out of the borehole 12, for example, the traveling block 114 is moved upward at the rig, and the drillstring 14 is first accelerated and then reaches a peak speed. Therefore, the acceleration time segment can be estimated (Block 414) while adjustments for swab effects are made. (As the traveling block 114 reaches its extent in the rig, the drillstring 14 may be decelerated so that a deceleration time segment may be estimated (Block 414) while adjustments for swab effects are made.) While the block 114 remains stationary and velocity is zero (Block 414), the ESD is the mud weight plus the additional factors of temperature and compressibility and any SBP that applied while static, and different adjustments are needed to maintain the bottom hole pressure. To trip the drillstring 14 into the borehole 12, the traveling block 114 is moved downward at the rig, and the drillstring 14 is first accelerated and then reaches a peak speed, therefore the acceleration time segment can be estimated (Block 414) while adjustments for surge effects are made. (As the block 114 reaches its extent in the rig, the drillstring 14 may be decelerated so that a deceleration time segment can be estimated (Block 416) while adjustments for surge effects are made.)

Accordingly, for the acceleration (Block 414), a first segment of the time span to move the traveling block 114 at the peak speed is calculated in which the block 114 is accelerated for a first portion of the distance to keep the peak speed. For the deceleration (Block 416), a second segment of the time span to move the traveling block 114 at the peak speed is calculated in which the block 114 is decelerated for a second portion of the distance to keep the peak speed.

For such operations of POOH or RIH, the time interval can be divided into an acceleration segment, a constant speed segment, and a deceleration segment. The acceleration segment lasts for a time period of $t_{acceleration}$, during which an acceleration tripping distance $L_{acc}$ is estimated as $$L_{acc} = \frac{V_{peak} t_{acc}}{3}$$

(assuming cubic velocity dependence from time). Should the acceleration tripping distance $L_{acc}$ be larger than half the length $L_{stand}/2$ for a stand, then the determination needs to be adjusted.

The constant speed segment is calculated to last $$t_{const} = \frac{L_{stand} - 2\ L_{acc}}{V_{peak}}.$$

The constant speed segment of the trip can be absent or only brief. For its part, the deceleration segment is symmetrical to acceleration segment.

For the trip at the calculated peak speed with these acceleration/constant/deceleration segments, the processing unit 210 calculates adjustments to the surface backpressure of the drilling system 10 to keep the downhole pressure within a tolerance of the formation (Block 420). These tolerances call for a target bottom hole pressure being at least less than one of: (i) a fracture pressure gradient of the formation for the trip of the drillstring 14 into the borehole 12 expected to produce surging as the piston effect, and (ii) a pore pressure gradient of the formation for the trip of the drillstring 14 out of the borehole 12 expected to produce swabbing as the piston effect. The target bottom hole pressure can be specified at any depth in the well, can be based on whether there is circulation or not, and can rely on additional factors. Because the BHA 16 at the end of the drillstring 14 may result in most of the swabbing and surging effects, the depth of investigation may be the depth of the BHA 16 in the borehole 12.

Having determined a peak speed for the trip and having calculated the adjustments to the surface backpressure for the conditions, the process 400 can proceed with performing the trip. The control system 200 can then move the traveling block 114 according to the peak speed and time segments when POOH and/or RIH (Block 422).

During the movement, the processing unit 210 adjusts the setpoints for the surface backpressure and the choke and controls the choke position with the automatic adjustments to change the surface backpressure, counteract the swab and surge effects, and maintain the bottom hole pressure within the tolerances (Block 424). To adjust the surface backpressure, the processing unit 210 adjusts a position of at least one of the chokes 122*a-b* in fluid communication with the fluid flowing out of the borehole 12 in the closed loop, thereby increasing/decreasing the surface backpressure and controlling the bottom hole pressure downhole.

As noted previously, the control system 200 in a second arrangement can receive the block position, can calculate the speed of the pipe movement, and can adjust the choke position according to the hydraulics model 224. To that end, FIG. 4B illustrates a process 400*b* for drilling a borehole and counteracting swab/surge effects according to the present disclosure when tripping the drillstring.

Similar to the previous process, the processing unit 210 in this process 400*b* obtains drilling inputs by monitoring a number of parameters (Block 402), including the current traveling block position, current choke position, surface backpressure measurement, current drilling depth, and the end of pipe condition (403). From some of these inputs (403), the current bottom hole pressure is calculated (Block 404), and setpoints for the choke(s) 122*a-b* and the surface backpressure are calculated (Block 406).

Eventually, some form of trip must be made during drilling in which the drillstring 14 is pulled out of hole and then run in hole. The processing unit 210 identifies an instance when a trip for the drillstring 14 in the borehole 12 is needed, planned, initiated, started, or the like (Decision 408). For the identified trip (Block 408), the processing unit 210 receives the block position over time (Block 430) and calculates the speed of the pipe movement from the received block positions (Block 432), and calculates the required SBP setpoint for the specific trip speed to trip (POOH, RIH) the drillstring 14 in the borehole 12 (Block 434).

Here, the traveling block 114 may be separately controlled by other rig systems. Preferably, the traveling block 114 moves the drillstring 14 at a peak optimal speed as disclosed herein, which can be calculated by the control system 200 and can be provided to another rig system or an operator. However, the control system 200 may not directly control the pipe movement so that the control system 200 needs to monitor the position of the traveling block 114.

During the pipe movement, the processing unit 210 adjusts the setpoints for the surface backpressure and the choke and controls the choke position with the automatic adjustments to change the surface backpressure, counteract the swab and surge effects, and maintain the bottom hole pressure within the tolerances (Block 436). To adjust the surface backpressure, the processing unit 210 adjusts a position of at least one of the chokes 122*a-b* in fluid communication with the fluid flowing out of the borehole 12 in the closed loop, thereby increasing/decreasing the surface backpressure and controlling the bottom hole pressure downhole.

As noted previously, the control system 200 in a second arrangement can receive the block speed (and hence the speed of the pipe movement) and can adjust the choke position according to the hydraulics model 224. To that end, FIG. 4*c* illustrates a process 400*c* for drilling a borehole and counteracting swab/surge effects according to the present disclosure when tripping the drillstring.

Similar to the previous processes, the processing unit 210 in this process 400*c* obtains drilling inputs by monitoring a number of parameters (Block 402), including the current traveling block position, current choke position, surface backpressure measurement, current drilling depth, and the end of pipe condition (403). From some of these inputs (403), the current bottom hole pressure is calculated (Block 404), and setpoints for the choke(s) 122*a-b* and the surface backpressure are calculated (Block 406).

Eventually, some form of trip must be made during drilling in which the drillstring 14 is pulled out of hole and then run in hole. The processing unit 210 identifies an instance when a trip for the drillstring 14 in the borehole 12 is needed, planned, initiated, started, or the like (Decision 408). For the identified trip (Block 408), the processing unit 210 receives the speed of the traveling block 114, which equates to the speed of the pipe movement (Block 440). The processing unit 210 then calculates the required SBP setpoint for the specific trip speed to trip (POOH, RIH) the drillstring 14 in the borehole 12 (Block 442).

Here, the traveling block 114 may be separately controlled by other rig systems. Preferably, the traveling block 114 moves the drillstring 14 at a peak optimal speed as disclosed herein, which can be calculated by the control system 200 and can be provided to another rig system or an operator. However, the control system 200 may not directly control the pipe movement so the control system 200 needs to monitor the position of the traveling block 114.

During the pipe movement, the processing unit 210 adjusts the setpoints for the surface backpressure and the choke and controls the choke position with the automatic adjustments to change the surface backpressure, counteract the swab and surge effects, and maintain the bottom hole pressure within the tolerances (Block 444). To adjust the surface backpressure, the processing unit 210 adjusts a position of at least one of the chokes 122*a-b* in fluid communication with the fluid flowing out of the borehole 12 in the closed loop, thereby increasing/decreasing the surface backpressure and controlling the bottom hole pressure downhole.

As can be seen by the compensation processes 400*a-c* of FIGS. 4A-4C, the swab/surge control 216 determines what change in surface backpressure is needed to counteract the increase/decrease in the bottom hole pressure due to surging/swabbing effects of moving the drillstring 14 at a peak speed in the borehole 12. In this way, the swab/surge control 216 determines what amount of adjustment in the surface backpressure is needed and knows the peak speed of tripping the drillstring 14. The swab/surge control 216 then interpolates each position of the traveling bock 114 and interpolates the required choke adjustments to achieve the target bottom hole pressure with the applied changes in the surface backpressure.

To calculate the adjustments to the surface backpressure of the drilling system 10 for the trip of the drillstring 14 at the calculated peak speed, the processing unit 210 can divide an amount of a change, expected in the downhole pressure produced by the piston effect, into a plurality of discrete increments. Then, the processing unit 210 can automatically adjust the surface backpressure sequentially with the discrete increments during the trip of the drillstring 14 in the borehole 12 according the calculated peak speed. For example, the processing unit 210 can increase the surface backpressure a stepped amount at one or more discrete intervals while pulling the drillstring 14 out of the borehole 12 in the trip and can decrease the surface backpressure the stepped amount at the one or more discrete intervals while running the drillstring 14 in the borehole 12 in the trip.

As will be appreciated, there will be some delay between the automatic adjustment of the surface back pressure (produced by the changes in the choke position) and the actual change in the bottom hole resulting therefrom. Accordingly, the stepped amount and the discrete intervals may be configured to account for such a delayed response.

Figure 5B:
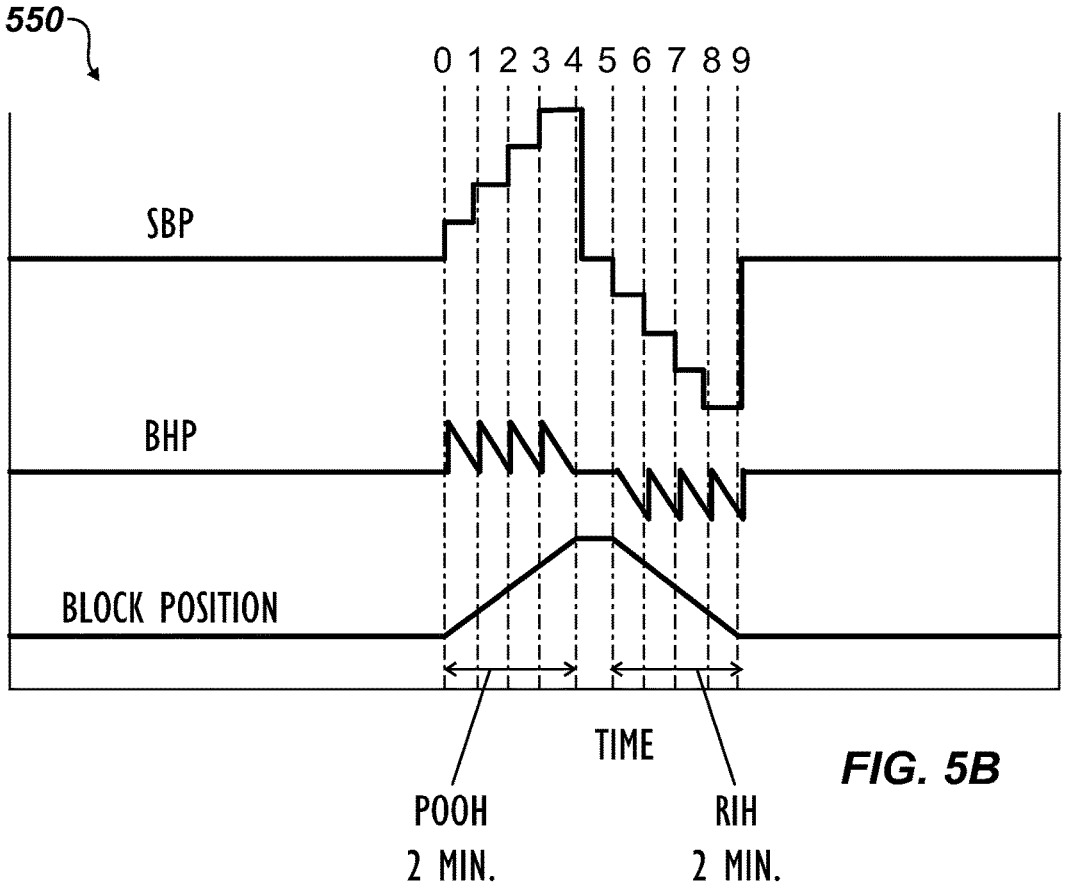
FIG. 5B schematically illustrates an example of the control system's operation according to the disclosed process.

As a particular example of the stepped adjustments at discrete intervals, FIG. 5B diagrams a graph 550 of the compensation process 400 of the present disclosure in counteracting swab and surge effects when moving the drillstring 14 in a reaming operation between connections. The graph 550 shows the movement of the traveling block 114 at the peak speed (Block Position) relative to adjustments of the surface backpressure (SBP) and the resulting changes in the bottom hole pressure (BHP).

According to the purposes of the present disclosure, the swab and surging effects of the pipe movement at the peak speed combined with the adjustments to the surface back pressure (SBP) result in corrections to the bottom hole pressure (BHP) to a target value, preferably within the tolerance of the formation at the current depth. As shown, the pipe movement in this example is given by block position and involves a POOH section, a static section, and a RIH section for illustrative purposes. Other trip operations could apply in a given situation. The pipe movement is divided into a number of time segments of 30-seconds each.

During the POOH section, the traveling block 114 is moved at a peak speed for a time interval. In this example, the block 114 is moved 22.5-ft in each 30-second segment for a time interval of 2-minutes so that the block 114 is moved a total of 90-feet in the derrick. As noted, this peak speed is determined from the hydraulics model 224 and is suited to the current operations.

Swabbing occurs downhole due to the pipe movement at this peak speed. To counteract how the swabbing may tend to decrease the bottom hole pressure (BHP), the surface backpressure (SBP) is adjusted at stepped increments in each time interval. Here, each stepped increment is a 25-psi increase in each 30-second interval, resulting in an increase of 100-psi of the SBP, say from 450-psi to 550-psi. As noted above, the expected change in the bottom hole pressure (BHP) caused by the swab effect of moving the drillstring 12 at the given depth out of the borehole 12 at the determined peak speed indicates what amount of change in the surface backpressure is needed to counteract the change in the downhole pressure. In turn, the incremental increases in the surface backpressure (SBP) are achieved by the automatic adjustments to the choke(s) 122*a-b* of the drilling system 10. In the end, the increased surface backpressure (SBP) from the choke adjustments and the resulting decrease in the downhole pressure from the swabbing act together to maintain the bottom hole pressure (BHP) at a target value.

As the traveling block 114 reaches its top extent, the surface backpressure (SBP) is dropped back to its initial condition by releasing the choke(s) 122*a-b*, and the surface backpressure (SBP) is held for a time interval, say 30-seconds.

During the RIH section, the traveling block 114 is moved at a peak speed for a time interval. In this example, the block 114 is moved 22.5-ft in each 30-second interval for a trip time of 2-minutes so that the block 114 is moved a total of 90-ft.

Surging occurs downhole due to the pipe movement at the peak speed. To counteract how the surging may tend to increase the bottom hole pressure (BHP), the surface backpressure (SBP) is adjusted at stepped increments in each segment. Here, each stepped increment is a 25-psi decrease in each 30-second segment, resulting in a decrease of 100-psi of the surface backpressure (SBP), say from 450-psi to 350-psi. As noted above, the expected change in the bottom hole pressure (BHP) caused by the surge effect of moving the drillstring 12 at the given depth into the borehole 12 at the determined peak speed indicates what amount of change in the surface backpressure is needed to counteract the change in the downhole pressure. In turn, the incremental decreases in the surface backpressure (SBP) are achieved by the automatic adjustments to the choke(s) 122*a-b* of the drilling system 10. In the end, the decreased surface backpressure (SBP) from the choke adjustments and the resulting increase in the downhole pressure from the surging act together to maintain the bottom hole pressure (BHP) at a target value.

As the block 114 reaches its bottom extent, the surface backpressure (SBP) is brought back to its initial condition so drilling ahead with the managed pressure can be performed.

Although described with reference to tripping drillstring having stands of drillpipe, the present teachings can be applied to tripping of other types of tubulars in an MPD operation. For example, casing of suitable size can be tripped into the hole and passed through the RCD while the RCD bearing and seal are installed. The surging control provided by the present teachings can be used to control the tripping speed of RIH for the casing and to make the automatic adjustments to the choke to maintain a target bottom hole pressure.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

As will be appreciated, teachings of the present disclosure can be implemented in digital electronic circuitry, computer hardware, computer firmware, computer software, programmable logic controller, or any combination thereof. Teachings of the present disclosure can be implemented in a programmable storage device (computer program product tangibly embodied in a machine-readable storage device) for execution by a programmable control device or processor (e.g., control system 200, processing unit 210, etc.) so that the programmable processor executing program instructions can perform functions of the present disclosure. The teachings of the present disclosure can be implemented advantageously in one or more computer programs that are executable on a programmable system (e.g., control system 200, processing unit 210, etc.) including at least one programmable processor coupled to receive data and instructions from, and to transmit data and instructions to, a data storage system (e.g., database 220), at least one input device, and at least one output device. Storage devices suitable for tangibly embodying computer program instructions and data include all forms of non-volatile memory, including by way of example semiconductor memory devices, such as solid-state devices, EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of drilling a borehole in a formation using a drilling system, the drilling system circulating fluid in a closed loop between a drillstring and the borehole, the method comprising:

identifying a trip to move the drillstring in the borehole, the trip expected to produce a piston effect that changes a downhole pressure of the fluid in the borehole;

calculating, in response to the identified trip, a speed to move the drillstring in the borehole for the trip;

determining, with the calculation of the speed, an adjustment to a surface backpressure of the drilling system for the trip of the drillstring at the speed to keep the downhole pressure within a tolerance of the formation by dividing an amount of the adjustment, to counter the downhole pressure produced by the piston effect, into a plurality of discrete increments; and moving the drillstring in the trip according to the speed while counteracting the downhole pressure change produced by the piston effect by automatically adjusting the surface backpressure according to the determined adjustment in a proactive way.

2. The method of claim 1, wherein identifying the trip comprises identifying an instance for pulling the drillstring out of the borehole that produces swabbing as the piston effect decreasing the downhole pressure of the fluid in the borehole.

3. The method of claim 1, wherein identifying the trip comprises identifying an instance for running the drillstring in the borehole that produces surging as the piston effect increasing the downhole pressure of the fluid in the borehole.

4. The method of claim 1, wherein moving the drillstring in the trip according to the speed comprises obtaining the speed of the drillstring in the borehole for the trip by receiving positions of a traveling block over time and determining the speed of the drillstring in the borehole from the received block positions.

5. The method of claim 1, wherein moving the drillstring in the trip according to the speed comprises obtaining the speed of the drillstring in the borehole for the trip by receiving a block speed of the traveling block and determining the speed of the drillstring in the borehole from the received block speed.

6. The method of claim 1, wherein calculating the speed to move the drillstring comprises determining a peak value of the speed from hydraulic modelling of the drilling system.

7. The method of claim 1, wherein determining the adjustment to the surface backpressure of the drilling system for the trip of the drillstring at the speed to keep the downhole pressure within the tolerance of the formation comprises determining a target of the downhole pressure at a depth in the borehole within the tolerance of the formation.

8. The method of claim 7, wherein determining the target of the downhole pressure comprises determining the target downhole pressure as being at least less than one of: (i) a fracture pressure gradient of the formation for the trip of the drillstring into the borehole expected to produce surging as the piston effect, and (ii) a pore pressure gradient of the formation for the trip of the drillstring out of the borehole expected to produce swabbing as the piston effect.

9. The method of claim 1, wherein automatically adjusting the surface backpressure according to the determined adjustment during the trip of the drillstring in the borehole according the speed comprises automatically adjusting the surface backpressure sequentially with the discrete increments during the trip of the drillstring in the borehole according the speed.

10. The method of claim 1, wherein moving the drillstring in the trip according the speed comprises operating drawworks to move a travelling block connected to the drillstring at a rig of the drilling system.

11. The method of claim 1, wherein adjusting the surface backpressure comprises adjusting a position of at least one choke in fluid communication with the fluid flowing out of the borehole in the closed loop.

12. The method of claim 1, further comprising monitoring one or more of: a position of at least one choke in fluid communication with the fluid flowing out of the borehole in the closed loop; a measurement of the surface backpressure of the drilling system upstream of the at least one choke; a current depth of the drilling system in the borehole; a current position of a traveling block connected to the drillstring at a rig of the drilling system; and a current end-of-pipe condition on the drilling system in the borehole.

13. The method of claim 1, further comprising handling the piston effect when moving the drillstring in the trip according to the speed by performing the automatic adjustment in a reactive way.

14. A method of drilling a borehole in a formation using a drilling system, the drilling system circulating fluid in a closed loop between a drillstring and the borehole, the method comprising:

identifying a trip to move the drillstring in the borehole, the trip expected to produce a piston effect that changes a downhole pressure of the fluid in the borehole;

calculating, in response to the identified trip, a speed to move the drillstring in the borehole for the trip by:

determining a distance and a time span for the movement of the drillstring with a traveling block of the drilling system;

determining a first interval of the time span in which the traveling block is accelerated for a first portion of the distance to keep the speed; and determining a second interval of the time span in which the traveling block is decelerated for a second portion of the distance to keep the speed;

determining, with the calculation of the speed, an adjustment to a surface backpressure of the drilling system for the trip of the drillstring at the speed to keep the downhole pressure within a tolerance of the formation; and moving the drillstring in the trip according to the speed while counteracting the downhole pressure change produced by the piston effect by automatically adjusting the surface backpressure according to the determined adjustment in a proactive way.

15. The method of claim 14, wherein determining the adjustment to the surface backpressure of the drilling system for the trip of the drillstring at the speed comprises dividing an amount of the adjustment, to counter the downhole pressure produced by the piston effect, into a plurality of discrete increments; and wherein automatically adjusting the surface backpressure according to the determined adjustment during the trip of the drillstring in the borehole according the speed comprises automatically adjusting the surface backpressure sequentially with the discrete increments during the trip of the drillstring in the borehole according the speed.

16. A method of of drilling a borehole in a formation using a drilling system, the drilling system circulating fluid in a closed loop between a drillstring and the borehole, the method comprising:

identifying a trip to move the drillstring in the borehole, the trip expected to produce a piston effect that changes a downhole pressure of the fluid in the borehole;

calculating, in response to the identified trip, a speed to move the drillstring in the borehole for the trip;

determining, with the calculation of the speed, an adjustment to a surface backpressure of the drilling system for the trip of the drillstring at the speed to keep the downhole pressure within a tolerance of the formation by:

determining a first change in the downhole pressure at a defined depth produced by the piston effect from the movement of the drillstring a distance in the borehole over a time span;

determining a second change in the surface backpressure to counter the first change in the downhole pressure and keep the downhole pressure within the tolerance of the formation; and dividing the second change in the surface backpressure into discrete increments at intervals of the time span; and moving the drillstring in the trip according to the speed while counteracting the downhole pressure change produced by the piston effect by automatically adjusting the surface backpressure according to the determined adjustment in a proactive way.

17. A method of drilling a borehole in a formation using a drilling system, the drilling system circulating fluid in a closed loop between a drillstring and the borehole, the method comprising:

identifying a trip to move the drillstring in the borehole, the trip expected to produce a piston effect that changes a downhole pressure of the fluid in the borehole;

calculating, in response to the identified trip, a speed to move the drillstring in the borehole for the trip;

determining, with the calculation of the speed, an adjustment to a surface backpressure of the drilling system for the trip of the drillstring at the speed to keep the downhole pressure within a tolerance of the formation; and moving the drillstring in the trip according to the speed while counteracting the downhole pressure change in the borehole produced by the piston effect from the movement of the drillstring comprises automatically adjusting the surface backpressure according to the determined adjustment during the trip of the drillstring in the borehole in a proactive way by:

increasing the surface backpressure a stepped amount at one or more discrete intervals while pulling the drillstring out of the borehole in the trip; or decreasing the surface backpressure the stepped amount at the one or more discrete intervals while running the drillstring in the borehole in the trip.

18. The method of claim 17, wherein determining the adjustment to the surface backpressure of the drilling system for the trip of the drillstring at the speed comprises dividing an amount of the adjustment, to counter the downhole pressure produced by the piston effect, into a plurality of discrete increments; and wherein automatically adjusting the surface backpressure according to the determined adjustment during the trip of the drillstring in the borehole according the speed comprises automatically adjusting the surface backpressure sequentially with the discrete increments during the trip of the drillstring in the borehole according the speed.

19. A system for drilling a borehole in a formation, the drilling system circulating fluid in a closed loop between a drillstring and the borehole, the system comprising:

storage storing a hydraulic model of the drilling system drilling the borehole; and a programmable control device communicatively coupled to the storage, the programmable control device being configured to perform the steps of the method according to claim 1.

20. The system of claim 19, further comprising:

a drawwork operable to move the drillstring in the borehole;

at least one pump disposed at an inlet of the system and operable to pump the drilling fluid into the borehole through the drillstring;

at least one choke disposed at an outlet of the system and operable to adjust flow of the drilling fluid from the borehole; and a sensor configured to measure a value of surface backpressure upstream of the at least one choke.

21. The system of claim 19, wherein the programmable control device is configured to control movement of the drillstring in the trip according to the speed.

22. The system of claim 19, wherein to automatically adjust the surface backpressure according to the determined adjustment during the trip of the drillstring in the borehole according the speed, the programmable control device is configured to automatically adjust the surface backpressure sequentially with the discrete increments during the trip of the drillstring in the borehole according the speed.

* * * * *